US010852655B2

(12) United States Patent
Kamiyoshi et al.

(10) Patent No.: US 10,852,655 B2
(45) Date of Patent: Dec. 1, 2020

(54) LIQUID DEVELOPER

(71) Applicant: Kao Corporation, Tokyo (JP)

(72) Inventors: Nobumichi Kamiyoshi, Wakayama (JP); Yuri Nannichi, Wakayama (JP); Kunihiro Kano, Wakayama (JP); Akito Itoi, Wakayama (JP); Tatsuya Yamada, Wakayama (JP)

(73) Assignee: Kao Corporation, Tokyo (JP)

( * ) Notice: Subject to any disclaimer, the term of this patent is extended or adjusted under 35 U.S.C. 154(b) by 10 days.

(21) Appl. No.: 16/331,297

(22) PCT Filed: Sep. 15, 2017

(86) PCT No.: PCT/JP2017/033465
§ 371 (c)(1),
(2) Date: Mar. 7, 2019

(87) PCT Pub. No.: WO2018/074124
PCT Pub. Date: Apr. 26, 2018

(65) Prior Publication Data

US 2019/0354033 A1 Nov. 21, 2019

(30) Foreign Application Priority Data

Oct. 17, 2016 (JP) ..... 2016-203458

(51) Int. Cl.

| | |
|---|---|
| ***G03G 9/135*** | (2006.01) |
| ***G03G 9/125*** | (2006.01) |
| ***G03G 9/13*** | (2006.01) |
| ***G03G 15/10*** | (2006.01) |
| ***G03G 15/20*** | (2006.01) |

(52) U.S. Cl.
CPC ..... *G03G 9/125* (2013.01); *G03G 9/131* (2013.01); *G03G 9/132* (2013.01); *G03G 9/135* (2013.01); *G03G 15/10* (2013.01); *G03G 15/20* (2013.01)

(58) Field of Classification Search
CPC ..... G03G 9/12; G03G 9/125; G03G 9/13; G03G 9/131; G03G 9/132; G03G 9/133
See application file for complete search history.

(56) References Cited

U.S. PATENT DOCUMENTS

2003/0104304 A1* 6/2003 Nicholls ..... G03G 9/122 430/116
2008/0318144 A1* 12/2008 Watanabe ..... G03G 9/0806 430/48
2010/0014894 A1 1/2010 Ueno et al.
2011/0305986 A1* 12/2011 Ogawa ..... G03G 9/0804 430/108.4
2014/0186764 A1 7/2014 Yamada et al.
2015/0160577 A1* 6/2015 Yamada ..... G03G 9/135 430/114
2015/0198903 A1* 7/2015 Deroover ..... G03G 9/0804 430/117.1
2016/0085170 A1* 3/2016 Momotani ..... G03G 9/132 430/114
2018/0239269 A1 8/2018 Yamada et al.

FOREIGN PATENT DOCUMENTS

| | | | | |
|---|---|---|---|---|
| JP | 8-36277 A | | 2/1996 | |
| JP | H08-036277 | * | 2/1996 | ..... G03G 9/12 |
| JP | 2003-195573 A | | 7/2003 | |
| JP | 2009-229608 A | | 10/2009 | |
| JP | 2010-25971 A | | 2/2010 | |
| JP | 2011-242457 A | | 12/2011 | |
| JP | 2014-092579 | * | 5/2014 | ..... G03G 9/12 |
| JP | 2014-142624 A | | 8/2014 | |
| JP | 2016-90843 A | | 5/2016 | |
| JP | 2017-54025 A | | 3/2017 | |
| JP | 2017-134137 A | | 8/2017 | |
| WO | WO 2010/106873 A1 | | 9/2010 | |
| WO | WO 2017/033772 A1 | | 3/2017 | |

OTHER PUBLICATIONS

Translation of H08-036277.*
Translation of 2014-092579.*
International Search Report dated Oct. 17, 2017 in PCT/JP2017/033465, 2 pages.

* cited by examiner

*Primary Examiner* — Peter L Vajda
(74) *Attorney, Agent, or Firm* — Oblon, McClelland, Maier & Neustadt, L.L.P.

(57) ABSTRACT

A liquid developer containing a resin binder, a colorant, a dispersant, and an insulating liquid, wherein the resin binder contains a resin having an acidic group, and wherein the dispersant contains a dispersant X having at least one basic nitrogen-containing group selected from the group consisting of an amino group, an imino group, a cyano group, an azo group, a diazo group, and an azide group, and wherein a melting point of the dispersant X is 34° C. or higher; and a method for printing a fused image using the liquid developer. The liquid developer of the present invention is suitably used in development or the like of latent images formed in, for example, electrophotography, electrostatic recording method, electrostatic printing method or the like.

17 Claims, No Drawings

LIQUID DEVELOPER

FIELD OF THE INVENTION

The present invention relates to a liquid developer usable in development of latent images formed in, for example, electrophotography, electrostatic recording method, electrostatic printing method or the like, and a method for printing using the liquid developer.

BACKGROUND OF THE INVENTION

Electrophotographic developers are a dry developer in which toner components composed of materials containing a colorant and a resin binder are used in a dry state, and a liquid developer in which toner components are dispersed in an insulating liquid.

In a liquid developer, toner particles are dispersed in oil in an insulating liquid, thereby making it possible to form smaller particle sizes as compared to a dry developer. Therefore, high-quality printouts can be obtained surpassing offset printing or gravure printing, so that the liquid developer is suitable for applications in commercial printings and industrial printings.

Patent Publication 1 discloses a liquid developer comprising a resin binder (A), a colorant (B), a polymer dispersant (C), and a carrier liquid (D), characterized in that the polymer dispersant (C) is prepared by copolymerizing at least an ethylenically unsaturated monomer having an amino group and an ethylenically unsaturated monomer having an alkyl group having 9 to 24 carbon atoms, and has an amine value of from 5 to 150 mgKOH/g, and that the carrier liquid (D) is an aliphatic hydrocarbon, wherein a proportion of a primary carbon is 55% or more, and a proportion of a secondary carbon is 30% or less, of the total number of carbon atoms of primary to tertiary carbons of the aliphatic hydrocarbon.

Patent Publication 2 discloses a wet type developer comprising toner particles at least containing one or more colorants and a resin binder, dispersed in a carrier liquid, wherein the colorant at least contains a pigment having a basic group, and wherein the resin binder is a polyester resin containing an aromatic carboxylic acid having three or more carboxyl groups in the molecule as a monomer constituting unit.

Patent Publication 1: Japanese Patent Laid-Open No. 2016-90843

Patent Publication 2: WO 2010/106873

SUMMARY OF THE INVENTION

The present invention relates to:

[1] a liquid developer containing a resin binder, a colorant, a dispersant, and an insulating liquid, wherein the resin binder contains a resin having an acidic group, and wherein the dispersant contains a dispersant X having at least one basic nitrogen-containing group selected from the group consisting of an amino group, an imino group, a cyano group, an azo group, a diazo group, and an azide group, a melting point of the dispersant X is 34° C. or higher;

[2] a liquid developer according to the above [1], wherein the dispersant X has a propylene backbone;

[3] a liquid developer according to the above [1] or [2], wherein the resin having an acidic group is a modified polyester resin having a urethane bond;

[4] a method for printing a fused image on a resin film using a liquid developer as defined in any one of the above [1] to [3], wherein the resin film is a polyethylene terephthalate film;

[5] a method for printing a fused image on a resin film using a liquid developer as defined in the above [2] or [3], wherein the resin film is a polypropylene film; and

[6] a method for printing a fused image on a resin film using a liquid developer as defined in the above [3], wherein the resin film is a nylon film.

DETAILED DESCRIPTION OF THE INVENTION

In recent years, applications of printouts have been extended to not only papers but also resin films made of materials such as polyethylene terephthalate (PET), polypropylene (PP), vinyl chloride, and nylons.

However, when a fused image is printed on a resin film, in order to fuse toner particles, a pretreatment step of applying a surface modification agent to a resin film has been necessitated, so that not only larger scaled printing apparatuses and complicated systems are required, but also the image quality may be lowered.

The present invention relates to a liquid developer which is fusible to a resin film which is not subjected to a pretreatment with a surface modification agent, and a method for printing using the liquid developer.

The liquid developer of the present invention can be suitably used also in fused image printing to a resin film which is not subjected to a pretreatment with a surface modification agent.

The liquid developer of the present invention contains a resin binder, a colorant, a dispersant, and an insulating liquid.

[Resin Binder]

The resin binder contains a resin having an acidic group. The resin having an acidic group can be adsorbed by the dispersant by an interaction with a dispersant X having a basic nitrogen-containing group, so that the resin binder has excellent dispersion stability.

The acidic group includes a carboxy group, a sulfo group, a phosphate group, and the like, among which a carboxy group is preferred, from the viewpoint of dispersion stability of the toner particles and availability.

Therefore, it is preferable that the resin having an acidic group is a polyester-based resin.

The polyester-based resin includes polyester resins, composite resins containing polyester resins and other resins such as styrenic resins, and the like. In addition, the polyester-based resin may be a modified polyester-based resin to an extent that the properties thereof are not substantially impaired.

In the present invention, it is preferable that the polyester resin is a polycondensate of an alcohol component containing a dihydric or higher polyhydric alcohol and a carboxylic acid component containing a dicarboxylic or higher polycarboxylic acid compound.

The dihydric alcohol includes, for example, aliphatic diols having 2 or more carbon atoms and 20 or less carbon atoms, and preferably having 2 or more carbon atoms and 15 or less carbon atoms; an alkylene oxide adduct of bisphenol A represented by the formula (I):

(I)

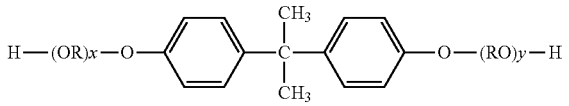

wherein RO and OR are an oxyalkylene group, wherein R is an ethylene group and/or a propylene group; and each of x and y is a positive number showing an average number of moles of alkylene oxide added, wherein a value of the sum of x and y is 1 or more, and preferably 1.5 or more, and 16 or less, preferably 8 or less, more preferably 6 or less, and even more preferably 4 or less. Specific examples of the diol having 2 or more carbon atoms and 20 or less carbon atoms include ethylene glycol, 1,2-propanediol, 1,3-propanediol, 1,4-butanediol, 1,6-hexanediol, bisphenol A, hydrogenated bisphenol A, and the like.

The alcohol component is preferably an alkylene oxide adduct of bisphenol A represented by the formula (I) or 1,2-propanediol, from the viewpoint of improving pulverizability of the toner, thereby obtaining toner particles having a smaller particle size, from the viewpoint of improving low-temperature fusing ability of the liquid developer, and from the viewpoint of improving dispersion stability of the toner particles, thereby improving storage stability. The alkylene oxide adduct of bisphenol A represented by the formula (I) is more preferred, from the viewpoint of pulverizability. Also, 1,2-propanediol is more preferred, from the viewpoint of storage stability. The content of the alkylene oxide adduct of bisphenol A represented by the formula (I) or 1,2-propanediol is preferably 50% by mol or more, more preferably 70% by mol or more, even more preferably 90% by mol or more, even more preferably 95% by mol or more, and even more preferably 100% by mol, of the alcohol component. When 1,2-propanediol and the alkylene oxide adduct of bisphenol A represented by the formula (I) are used together, it is preferable that a total content of both is within the above range.

The trihydric or higher polyhydric alcohol includes trihydric or higher polyhydric alcohols having 3 or more carbon atoms and 20 or less carbon atoms, and preferably having 3 or more carbon atoms and 10 or less carbon atoms. Specific examples include sorbitol, 1,4-sorbitan, pentaerythritol, glycerol, trimethylolpropane, and the like.

The dicarboxylic acid compound includes, for example, dicarboxylic acids having 3 or more carbon atoms and 30 or less carbon atoms, preferably having 3 or more carbon atoms and 20 or less carbon atoms, and more preferably having 3 or more carbon atoms and 10 or less carbon atoms, or anhydrides thereof, derivatives thereof such as alkyl esters of which alkyl has 1 or more carbon atoms and 3 or less carbon atoms, and the like. Specific examples include aromatic dicarboxylic acids such as phthalic acid, isophthalic acid, and terephthalic acid; and aliphatic dicarboxylic acids such as fumaric acid, maleic acid, succinic acid, glutaric acid, adipic acid, sebacic acid, and succinic acid substituted with an alkyl group having 1 or more carbon atoms and 20 or less carbon atoms or with an alkenyl group having 2 or more carbon atoms and 20 or less carbon atoms.

The carboxylic acid component is preferably terephthalic acid and/or fumaric acid, and more preferably terephthalic acid, from the viewpoint of improving low-temperature fusing ability of the toner, and from the viewpoint of improving dispersion stability of the toner particles, thereby improving storage stability. The content of the terephthalic acid or fumaric acid or a total content of terephthalic acid and fumaric acid is preferably 40% by mol or more, more preferably 50% by mol or more, even more preferably 70% by mol or more, even more preferably 90% by mol or more, even more preferably 95% by mol or more, and even more preferably 100% by mol, of the carboxylic acid component.

The tricarboxylic or higher polycarboxylic acid compound includes, for example, tricarboxylic or higher polycarboxylic acids having 4 or more carbon atoms and 20 or less carbon atoms, preferably having 6 or more carbon atoms and 20 or less carbon atoms, more preferably having 7 or more carbon atoms and 15 or less carbon atoms, even more preferably having 8 or more carbon atoms and 12 or less carbon atoms, and even more preferably having 9 or more carbon atoms and 10 or less carbon atoms, or anhydrides thereof, derivatives thereof such as alkyl esters of which alkyl has 1 or more carbon atoms and 3 or less carbon atoms and the like. Specific examples include 1,2,4-benzenetricarboxylic acid (trimellitic acid), 1,2,4,5-benzenetetracarboxylic acid (pyromellitic acid), or acid anhydrides thereof, and the like.

The content of the tricarboxylic or higher polycarboxylic acid compound is preferably 1% by mol or more, more preferably 2% by mol or more, and even more preferably 3% by mol or more, and preferably 30% by mol or less, more preferably 25% by mol or less, and even more preferably 20% by mol or less, of the carboxylic acid component, from the viewpoint of improving hot offset resistance of the toner and improving pulverizability of the toner particles.

Here, the alcohol component may contain a monohydric alcohol, and the carboxylic acid component may contain a monocarboxylic acid compound in proper amounts, from the viewpoint of adjusting a molecular weight and a softening point of the polyester resin.

The equivalent ratio of the carboxylic acid component to the alcohol component in the polyester resin, i.e. COOH group or groups/OH group or groups, is preferably 0.6 or more, more preferably 0.7 or more, and more preferably 0.75 or more, and preferably 1.1 or less, more preferably 1.05 or less, and even more preferably 1 or less, from the viewpoint of adjusting a softening point of the polyester resin.

The polyester resin can be produced, for example, by polycondensing the alcohol component and the carboxylic acid component in an inert gas atmosphere at a temperature of 130° C. or higher, and preferably 170° C. or higher, and 250° C. or lower, and preferably 240° C. or lower, preferably in the presence of an esterification catalyst, optionally in the presence of an esterification promoter, a polymerization inhibitor or the like.

The esterification catalyst includes tin compounds such as dibutyltin oxide and tin(II) 2-ethylhexanoate; titanium compounds such as titanium diisopropylate bistriethanolaminate; and the like, and the tin compounds are preferred. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The esterification promoter includes gallic acid, and the like. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component. The polymerization inhibitor includes t-butyl catechol, and the like. The amount of the polymerization inhibitor used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

Preferred modified polyester resins in the present invention include, for example, modified polyester resins having a urethane bond in which adhesiveness to a nylon film is excellent, i.e. urethane-modified polyester resins.

The urethane-modified polyester resin is obtained by, for example, synthesizing a polyester prepolymer obtained by polycondensation of a dihydric or higher polyhydric alcohol component and a dicarboxylic or higher polycarboxylic acid component, and stretching the above polyester using an isocyanate compound.

The equivalent molar ratio of the carboxylic acid component to the alcohol component used in the polyester prepolymer, i.e. OH group or groups/COOH group or groups, is preferably 100/40 or less, more preferably 100/55 or less, and even more preferably 100/60 or less, and preferably 100/100 or more, more preferably 100/90 or more, and even more preferably 100/80 or more, from the viewpoint of the reactivity with the isocyanate.

The isocyanate forms a urethane bond by bonding with the polyester prepolymer. This urethane bond improves adhesiveness to a nylon film.

Isocyanates are mainly classified into alicyclic isocyanates, aliphatic isocyanates, or aromatic isocyanates, and at least one member from aliphatic isocyanates and alicyclic isocyanates is preferred, from the viewpoint of reactivity and fusing ability.

The aliphatic isocyanate includes hexamethylene diisocyanate, trimethylhexamethylene diisocyanate, lysine diisocyanate, hexamethylene triisocyanate, and the like, among which hexamethylene diisocyanate is preferred.

The alicyclic isocyanate includes isophorone diisocyanate, dicyclohexylmethane diisocyanate, cyclohexane diisocyanate, cyclohexane triisocyanate, and the like, among which isophorone diisocyanate, dicyclohexylmethane diisocyanate, or cyclohexane diisocyanate is preferred.

Each of the aliphatic polyisocyanates and the alicyclic polyisocyanates mentioned above may be used alone or in a combination of two or more kinds.

Also, it is possible to use, in addition to the aliphatic polyisocyanate and the alicyclic polyisocyanate, an aromatic polyisocyanate within the range that would not impair the effects of the present invention. The aromatic polyisocyanate includes phenylene diisocyanate, tolylene diisocyanate, diphenylmethane diisocyanate, naphthalene diisocyanate, triphenylmethane triisocyanate, and the like, and polyisocyanates such as xylylene diisocyanate, tetramethyl xylylene diisocyanate, methylbenzene triisocyanate, and the like, and these aromatic polyisocyanates may be used alone or in a combination of two or more kinds.

The amount of the isocyanate used, based on 100 parts by mass of the polyester, is preferably 5 parts by mass or more, and more preferably 10 parts by mass or more, from the viewpoint of fusing ability of the liquid developer to a nylon film, and the amount used is preferably 100 parts by mass or less, and more preferably 50 parts by mass or less, from the viewpoint of dispersion stability of the liquid developer.

The method for synthesizing a urethane-modified polyester resin is not particularly limited, and the urethane-modified polyester resin is synthesized using various known methods, reaction catalysts, and reaction inhibitors. The urethane-modified polyester resin of the present invention may be a solvent-soluble type or may be an aqueous dispersible type such as a self-emulsification type or a forced emulsification type using a dispersant.

The method for self-emulsification or forced emulsification of the urethane-modified polyester resin is not particularly limited, and various kinds of known methods can be employed. A preferred method is one in which a diol having a carboxyalkyl as a side chain is added as a raw material, thereby introducing a carboxy group into a urethane resin to make the resin hydrophilic.

Other modified polyester resins include a polyester resin grafted or blocked with a phenol, an epoxy or the like according to a method described in Japanese Patent Laid-Open No. Hei-10-239903, Hei-8-20636, or the like.

As a composite resin, a composite resin containing the above polyester resin and a styrenic resin is preferred.

The styrenic resin is a product of addition polymerization of raw material monomers containing at least styrene or a styrene derivative such as α-methylstyrene or vinyltoluene (hereinafter, the styrene and styrene derivatives are collectively referred to as "styrenic compound").

The content of the styrenic compound, preferably styrene, in the raw material monomers for the styrenic resin, is preferably 50% by mass or more, more preferably 70% by mass or more, and even more preferably 80% by mass or more, from the viewpoint of improving dispersion stability of the toner particles, thereby improving storage stability, and the content is preferably 95% by mass or less, more preferably 93% by mass or less, and even more preferably 90% by mass or less, from the viewpoint of improving low-temperature fusing ability of the toner and from the viewpoint of improving wet milling property.

In addition, the styrenic resin may contain an alkyl (meth)acrylate of which alkyl group has 7 or more carbon atoms as a raw material monomer. The alkyl (meth)acrylate includes 2-ethylhexyl (meth)acrylate, (iso)octyl (meth)acrylate, (iso)decyl (meth)acrylate, (iso)stearyl (meth)acrylate, and the like. These alkyl (meth)acrylates are preferably used alone or in two or more kinds. Here, the expression "(iso)" as used herein means to embrace both cases where these groups are present and cases where they are absent, and in the cases where these groups are absent, they are normal form. Also, the expression "(meth)acrylic acid" is acrylic acid, methacrylic acid, or the both.

The number of carbon atoms of the alkyl group in the alkyl (meth)acrylate as the raw material monomers for the styrenic resin is preferably 7 or more, and more preferably 8 or more, from the viewpoint of improving low-temperature fusing ability of the toner, and the number of carbon atoms is preferably 12 or less, and more preferably 10 or less, from the viewpoint of storage stability. Here, the number of carbon atoms of the alkyl ester refers to the number of carbon atoms derived from the alcohol component constituting the ester.

The raw material monomers for styrene resins may contain raw material monomers other than the styrenic compound and the alkyl (meth)acrylate, including, for example, ethylenically unsaturated monoolefins such as ethylene and propylene; diolefins such as butadiene; halovinyls such as vinyl chloride; vinyl esters such as vinyl acetate and vinyl propionate; ethylenically monocarboxylic acid esters such as dimethylaminoethyl (meth)acrylate; vinyl ethers such as vinyl methyl ether; vinylidene halides such as vinylidene chloride; N-vinyl compounds such as N-vinylpyrrolidone; and the like.

The addition polymerization reaction of the raw material monomers for the styrenic resin can be carried out, for example, in the presence of a polymerization initiator such as dicumyl peroxide, a polymerization inhibitor, a crosslinking agent, or the like, and in the presence of an organic solvent or in the absence of a solvent, and the temperature conditions are preferably 110° C. or higher, and more preferably 140° C. or higher, and preferably 200° C. or lower, and more preferably 170° C. or lower.

When an organic solvent is used during the addition polymerization reaction, xylene, toluene, methyl ethyl ketone, acetone or the like can be used. The amount of the organic solvent used is preferably 10 parts by mass or more and 50 parts by mass or less, based on 100 parts by mass of the raw material monomers for the styrenic resin.

In the present invention, it is preferable that the composite resin is a resin in which a polyester resin and a styrenic resin are chemically bonded via a dually reactive monomer, which is capable of reacting with both the raw material monomers for the polyester resin and the raw material monomers for the styrenic resin, from the viewpoint of dispersion stability and pulverizability of the toner particles.

The dually reactive monomer is preferably a compound having within its molecule at least one functional group selected from the group consisting of a hydroxyl group, a carboxy group, an epoxy group, a primary amino group and a secondary amino group, preferably a hydroxyl group and/or a carboxy group, and more preferably a carboxy group, and an ethylenically unsaturated bond, and the dually reactive monomer is more preferably at least one member selected from the group consisting of acrylic acid, methacrylic acid, fumaric acid, maleic acid, and maleic anhydride, and, from the viewpoint of reactivities of the polycondensation reaction and addition polymerization reaction, even more preferably at least one member selected from the group consisting of acrylic acid, methacrylic acid, and fumaric acid. Here, in a case where the dually reactive monomer is used together with a polymerization inhibitor, a polycarboxylic acid compound having an ethylenically unsaturated bond such as fumaric acid functions as a raw material monomer for a polyester resin. In this case, fumaric acid or the like is not a dually reactive monomer, but a raw material monomer for a polyester resin.

In addition, the dually reactive monomer may be one or more (meth)acrylate esters selected from acrylate esters and methacrylate esters of which alkyl group has 6 or less carbon atoms.

The (meth)acrylate ester is preferably an alkyl (meth) acrylate, from the viewpoint of reactivity to transesterification, and the alkyl group has the number of carbon atoms of preferably 2 or more, and more preferably 3 or more, and preferably 6 or less, and more preferably 4 or less. The alkyl group may have a substituent such as a hydroxyl group.

Specific examples of the alkyl (meth)acrylate include methyl (meth)acrylate, ethyl (meth)acrylate, (iso)propyl (meth)acrylate, 2-hydroxyethyl (meth)acrylate, (iso or tertiary)butyl (meth)acrylate, hexyl (meth)acrylate, and the like. Here, the expression "(iso or tertiary)" means to embrace both cases where these groups are present and cases where they are absent, and in the cases where these groups are absent, they are normal form.

In the present invention, the acrylate ester is preferably an alkyl acrylate of which alkyl group has 2 or more carbon atoms and 6 or less carbon atoms, and more preferably butyl acrylate, and the methacrylate ester is preferably an alkyl methacrylate of which alkyl group has 2 or more carbon atoms and 6 or less carbon atoms, and more preferably butyl methacrylate.

The amount of the dually reactive monomer used, based on 100 mol of a total of the alcohol component of the polyester resin, is preferably 1 mol or more, and more preferably 2 mol or more, from the viewpoint of enhancing dispersibility of the styrenic resin and the polyester resin, thereby improving durability of the toner, and the amount of the dually reactive monomer used is preferably 30 mol or less, more preferably 20 mol or less, and even more preferably 10 mol or less, from the viewpoint of low-temperature fusing temperature.

In addition, the amount of the dually reactive monomer used, based on 100 parts by mass of a total of the raw material monomers for the styrenic resin, is preferably 1 part by mass or more, and more preferably 2 parts by mass or more, from the viewpoint of enhancing dispersibility of the styrenic resin and polyester resin, thereby improving durability of the toner, and the amount of the dually reactive monomer used is preferably 30 parts by mass or less, more preferably 20 parts by mass or less, and even more preferably 10 parts by mass or less, from the viewpoint of low-temperature fusing ability. Here, a total of the raw material monomers for the styrenic resin includes a polymerization initiator.

It is preferable that the composite resin obtained by using a dually reactive monomer is specifically produced in accordance with the following method. It is preferable that the dually reactive monomer is used in the addition polymerization reaction together with the raw material monomers for the styrenic resin, from the viewpoint of improving durability of the toner, and from the viewpoint of improving low-temperature fusing ability and heat-resistant storage property of the toner.

(i) Method including the steps of (A) carrying out a polycondensation reaction of raw material monomers for a polyester resin; and thereafter (B) carrying out an addition polymerization reaction of raw materials monomers for a styrenic resin and a dually reactive monomer In this method, the step (A) is carried out under reaction temperature conditions appropriate for a polycondensation reaction, a reaction temperature is then lowered, and the step (B) is carried out under temperature conditions appropriate for an addition polymerization reaction. It is preferable that the raw material monomers for the styrenic resin and the dually reactive monomer are added to a reaction system at a temperature appropriate for an addition polymerization reaction. The dually reactive monomer also reacts with the polyester resin as well as in the addition polymerization reaction.

After the step (B), a reaction temperature is raised again, a raw material monomer which is a trivalent or higher polyvalent monomer for a polyester resin serving as a crosslinking agent is optionally added to the reaction system, whereby the polycondensation reaction of the step (A) and the reaction with the dually reactive monomer can be further progressed.

(ii) Method including the steps of (B) carrying out an addition polymerization reaction of raw material monomers for a styrenic resin and a dually reactive monomer, and thereafter (A) carrying out a polycondensation reaction of raw material monomers for a polyester resin In this method, the step (B) is carried out under reaction temperature conditions appropriate for an addition polymerization reaction, a reaction temperature is then raised, and the step (A) a polycondensation reaction is carried out under temperature conditions appropriate for the polycondensation reaction. The dually reactive monomer is also involved in a polycondensation reaction as well as the addition polymerization reaction.

The raw material monomers for the polyester resin may be present in a reaction system during the addition polymerization reaction, or the raw material monomers for the polyester resin may be added to a reaction system under temperatures conditions appropriate for the polycondensation reaction. In the former case, the progress of the polycondensation reaction can be adjusted by adding an esterification catalyst at a temperature appropriate for the polycondensation reaction.

(iii) Method including carrying out reactions under the conditions of concurrently progressing the step (A) a polycondensation reaction of raw material monomers for a polyester resin and the step (B) an addition polymerization reaction of raw materials monomers for a styrenic resin and a dually reactive monomer In this method, it is preferable that the steps (A) and (B) are concurrently carried out under reaction temperature conditions appropriate for an addition polymerization reaction, a reaction temperature is raised, a raw material monomer which is a trivalent or higher polyvalent monomer for the polyester resin serving as a crosslinking agent is optionally added to a polymerization system under temperature conditions appropriate for a polycondensation reaction, and the polycondensation reaction of the step (A) is further carried out. During the process, the polycondensation reaction alone can also be progressed by adding a radical polymerization inhibitor under temperature conditions appropriate for the polycondensation reaction. The dually reactive monomer is also involved in a polycondensation reaction as well as the addition polymerization reaction.

In the above method (i), a polycondensation resin that is previously polymerized may be used in place of the step (A) carrying out a polycondensation reaction. In the above method (iii), when the steps (A) and (B) are concurrently progressed, a mixture containing raw material monomers for the styrenic resin can be added dropwise to a mixture containing raw material monomers for the polyester resin to react.

It is preferable that the above methods (i) to (iii) are carried out in a single vessel.

The mass ratio of the styrenic resin to the polyester resin in the composite resin, i.e. styrenic resin/polyester resin, is preferably 3/97 or more, more preferably 7/93 or more, and even more preferably 10/90 or more, from the viewpoint of pulverizability of the toner particles, and the mass ratio is preferably 45/55 or less, more preferably 40/60 or less, even more preferably 35/65 or less, even more preferably 30/70 or less, and even more preferably 25/75 or less, from the viewpoint of dispersion stability of the toner particles. Here, in the above calculation, the mass of the polyester resin is an amount in which the amount of reaction water (calculated value) dehydrated by the polycondensation reaction is subtracted from the mass of the raw material monomers for the usable polyester resin, and the amount of the dually reactive monomer is included in the amount of the raw material monomers for the polyester resin. Also, the mass of the styrenic resin is a total amount of the raw material monomers for the styrenic resin and the polymerization initiator.

The softening point of the polyester-based resin is preferably 70° C. or higher, and more preferably 75° C. or higher, from the viewpoint of improving dispersion stability of the toner particles, thereby improving storage stability, and the softening point is preferably 160° C. or lower, more preferably 130° C. or lower, even more preferably 120° C. or lower, and even more preferably 110° C. or lower, from the viewpoint of improving low-temperature fusing ability of the liquid developer.

The glass transition temperature of the polyester-based resin is preferably 40° C. or higher, and more preferably 45° C. or higher, from the viewpoint of improving dispersion stability of the toner particles, thereby improving storage stability, and the glass transition temperature is preferably 80° C. or lower, more preferably 70° C. or lower, and even more preferably 60° C. or lower, from the viewpoint of improving low-temperature fusing ability.

The acid value of the polyester-based resin is preferably 3 mgKOH/g or more, more preferably 5 mgKOH/g or more, and even more preferably 8 mgKOH/g or more, and preferably 60 mgKOH/g or less, more preferably 50 mgKOH/g or less, even more preferably 40 mgKOH/g or less, and even more preferably 30 mgKOH/g or less, from the viewpoint of reducing viscosity of the liquid developer, and from the viewpoint of improving dispersion stability of the toner particles, thereby improving storage stability. The acid value of the polyester-based resin can be adjusted by a method such as varying an equivalent ratio of the carboxylic acid component to the alcohol component, varying a reaction time during the production of the resin, or varying the content of the tricarboxylic or higher polycarboxylic acid compound.

The content of the polyester-based resin in the resin binder is preferably 90% by mass or more, more preferably 95% by mass or more, and even more preferably 100% by mass, i.e. only the polyester-based resin is used. However, other resin besides the polyester-based resin may be contained within the range that would not impair the effects of the present invention. The resins besides the polyester-based resin include, for example, one or more members selected from resins such as styrenic resins which are homopolymers or copolymers containing styrene or styrene substitutes, such as polystyrenes, styrene-propylene copolymers, styrene-butadiene copolymers, styrene-vinyl chloride copolymers, styrene-vinyl acetate copolymers, styrene-maleic acid copolymers, styrene-acrylate ester copolymers, and styrene-methacrylate ester copolymers, epoxy resins, rosin-modified maleic acid resins, polyethylene-based resins, polypropylene-based resins, polyurethane-based resins, silicone resins, phenol resins, and aliphatic or alicyclic hydrocarbon resins.

[Colorant]

As the colorant, dyes, pigments and the like which are used as colorants for toners can be used. Examples include carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, and the like. In the present invention, the toner particles may be any one of black toners and color toners.

The content of the colorant is preferably 5 parts by mass or more, more preferably 10 parts by mass or more, and even more preferably 15 parts by mass or more, based on 100 parts by mass of the resin binder, from the viewpoint of improving optical density, and the content is preferably 100 parts by mass or less, more preferably 70 parts by mass or less, even more preferably 50 parts by mass or less, and even more preferably 25 parts by mass or less, based on 100 parts by mass of the resin binder, from the viewpoint of improving pulverizability of the toner, thereby forming smaller particle sizes, from the viewpoint of improving low-temperature fusing ability, and from the viewpoint of improving dispersion stability of the toner particles, thereby improving storage stability.

[Dispersant]

Since the dispersant in the present invention contains a dispersant X having a basic nitrogen-containing group having a melting point of a given temperature or higher, the dispersant can be suitably used in fused image printing to a resin film which is not subjected to a pretreatment with a surface modification agent. The reasons therefor are not necessarily certain, and they are assumed to be as follows. In the present invention, a dispersant X acts as an adhesive for fusing toner particles on a resin film. A film surface is modified by localizing a dispersant on an interface of a film and toner particles, so that the dispersant is strongly adsorbed to the toner via an adsorbing group having a strong basicity, thereby firmly adhering a fused image on the film. By using a dispersant having a melting point of a given temperature or higher, a fused image becomes even firmer.

The basic nitrogen-containing group is at least one member selected from the group consisting of amino groups (—$NH_2$, —NHR, —NHRR'), an imino group (=NH), a cyano group (—CN), an azo group (—N=N—), a diazo group (=$N_2$), and an azide group (—$N_3$). Here, each of R and R' stands for a hydrocarbon group having from 1 to 5 carbon atoms. The imino group and/or amino groups are preferred, from the viewpoint of adsorbability of the dispersant to the toner particles, and the imino group is more preferred, from the viewpoint of availability. Here, although an amide group is a basic group, its basicity is very weak, so that the interactions with a resin having an acidic group are extremely weak, thereby completely not acting as an adhesive to a film.

The functional group contained besides the basic nitrogen-containing group includes, for example, a hydroxy group, a formyl group, an acetal group, an oxime group, a thiol group, and the like.

The proportion of the basic nitrogen-containing group occupying the dispersant X, as calculated in terms of the number of heteroatoms, is preferably 70% by number or more, more preferably 80% by number or more, even more preferably 90% by number or more, even more preferably 95% by number or more, and even more preferably 100% by number, from the viewpoint of dispersion stability and adhesiveness to a film.

It is preferable that the dispersant X contains a hydrocarbon having 16 or more carbon atoms, a hydrocarbon having 16 or more carbon atoms partly substituted with a halogen atom, a hydrocarbon having 16 or more carbon atoms having a reactive functional group, a polymer of a hydroxycarboxylic acid having 16 or more carbon atoms, a polymer obtained from a dibasic acid having 2 or more carbon atoms and 22 or less carbon atoms and a diol having 2 or more carbon atoms and 22 or less carbon atoms, a polymer of an alkyl (meth)acrylate having 16 or more carbon atoms, or a group derived from a polyolefin (hereinafter also referred to as "dispersible group"), from the viewpoint of dispersibility of the liquid developer.

The hydrocarbon having 16 or more carbon atoms is preferably a hydrocarbon having 16 or more carbon atoms and 24 or less carbon atoms, which includes, for example, hexadecene, octadecene, eicosane, docosane, and the like.

The hydrocarbon having 16 or more carbon atoms partly substituted with a halogen atom is preferably a hydrocarbon having 16 or more carbon atoms and 24 or less carbon atoms partly substituted with a halogen atom, which includes, for example, chlorohexadecane, bromohexadecane, chloroctadecane, bromooctadecane, chloroeicosane, bromoeicosane, chlorodocosane, bromodocosane, and the like.

The hydrocarbon having 16 or more carbon atoms having a reactive functional group is preferably a hydrocarbon having 16 or more carbon atoms and 24 or less carbon atoms, the hydrocarbon having a reactive functional group, which includes, for example, hexadecenylsuccinic acid, octadecenylsuccinic acid, eicosenylsuccinic acid, docosenylsuccinic acid, hexadecyl glycidyl ether, octadecyl glycidyl ether, eicosyl glycidyl ether, docosyl glycidyl ether, and the like.

The polymer of a hydroxycarboxylic acid having 16 or more carbon atoms is preferably a polymer of a hydroxycarboxylic acid having 16 or more carbon atoms and 24 and less carbon atoms, which includes, for example, a polymer of 18-hydroxystearic acid, and the like.

The polymer obtained from a dibasic acid having 2 or more carbon atoms and 22 or less carbon atoms and a diol having 2 or more carbon atoms and 22 or less carbon atoms includes, for example, a polymer obtained from ethylene glycol and sebacic acid, a polymer obtained from 1,4-butanediol and fumaric acid, a polymer obtained from 1,6-hexanediol and fumaric acid, a polymer obtained from 1,10-decanediol and sebacic acid, a polymer obtained from 1,12-dodecanediol and 1,12-dodecanedionic acid, and the like.

The polymer of an alkyl (meth)acrylate having 16 or more carbon atoms is preferably a polymer of an alkyl (meth) acrylate having 16 or more carbon atoms and 24 or less carbon atoms, which includes, for example, a polymer of hexadecyl methacrylate, a polymer of octadecyl methacrylate, a polymer of docosyl methacrylate, and the like.

The polyolefin includes, for example, polyethylene, polypropylene, polybutylene, polymethylpentene, polytetradecene, polyoctadecene, polyeicosene, polydocosene, and the like.

The dispersant X preferably has a polyolefin backbone, and more preferably having a polyethylene backbone and/or a polypropylene backbone, from the viewpoint of adhesiveness to a film, and the dispersant X even more preferably has a polypropylene backbone, from the viewpoint of raising the melting point of the dispersant. Therefore, among the above dispersible groups, a group derived from a polyolefin is preferred, a group derived from polyethylene and/or polypropylene is more preferred, and a group derived from polypropylene is even more preferred.

The dispersant X is not particularly limited, and obtained by, for example, reacting raw materials for a basic nitrogen-containing group and raw materials for a dispersible group.

The raw materials for a basic nitrogen-containing group include polyalkyleneimines such as polyethyleneimines, polyallylamines, polyaminoalkyl methacrylates such as poly (dimethylaminoethyl) methacrylates, and the like.

The number-average molecular weight of the raw materials for the basic nitrogen-containing group is preferably 100 or more, more preferably 500 or more, and even more preferably 1,000 or more, from the viewpoint of adsorbability to an acidic group owned by a resin, and the number-average molecular weight is preferably 15,000 or less, more preferably 10,000 or less, and even more preferably 5,000 or less, from the viewpoint of dispersibility of the toner particles and localization to the interface of the film and the toner particles.

The raw materials for a dispersible group include a halogenated hydrocarbon having 16 or more carbon atoms, a hydrocarbon having 16 or more carbon atoms having a reactive functional group, a polymer of a hydroxycarboxylic acid having 16 or more carbon atoms, a polymer obtained from a dibasic acid having 2 or more carbon atoms and 22 or less carbon atoms and a diol having 2 or more carbon atoms and 22 or less carbon atoms, a polymer of an alkyl (meth)acrylate having 16 or more carbon atoms having a reactive functional group, a polyolefin having a reactive functional group, and the like. Among them, the halogenated hydrocarbon having 16 or more carbon atoms, the hydrocarbon having 16 or more carbon atoms having a reactive functional group, the polymer of an alkyl (meth)acrylate having 16 or more carbon atoms and 24 or less carbon atoms having a reactive functional group, or a polyolefin having a reactive functional group is preferred, from the viewpoint of availability and reactivities of the raw materials. The reactive functional group includes a carboxy group, an epoxy group, a formyl group, an isocyanate group, and the like, among which a carboxy group or an epoxy group is preferred, from the viewpoint of safety and reactivity. Therefore, it is preferable that the compound having a reactive functional group is a carboxylic acid-based compound. The carboxylic acid-based compound includes fumaric acid, maleic acid, ethanoic acid, propanoic acid, butanoic acid, succinic acid, oxalic acid, malonic acid, tartaric acid, anhydrides thereof, or alkyl esters thereof of which alkyl has 1 or more carbon atoms and 3 or less carbon atoms, and the like.

Specific examples of the raw materials for a dispersible group include halogenated alkanes such as chlorooctadecane, epoxy-modified polyoctadecyl methacrylate, polyethylene succinic anhydride, chlorinated polypropylene, polypropylene succinic anhydride, and the like.

The content of the compound having a polypropylene backbone in the raw materials for a dispersible group is preferably 70% by mass or more, more preferably 80% by mass or more, even more preferably 90% by mass or more, and even more preferably 100% by mass, from the viewpoint of adhesiveness to a film.

The melting point of the compound having a polypropylene backbone is preferably 60° C. or higher, more preferably 70° C. or higher, and even more preferably 80° C. or higher, from the viewpoint of elevating a melting point of the dispersant, and the melting point is preferably 160° C. or lower, more preferably 150° C. or lower, and even more preferably 140° C. or lower, from the viewpoint of adhesiveness to a film.

The raw materials for a dispersible group having a polypropylene backbone include, for example, UMEX 100TS, UMEX 110TS, UMEX 1001, and UMEX 1010, manufactured by Sanyo Chemical Industries, Ltd.; HARDLEN 13-LP, HARDLEN 13-LLP, HARDLEN 14-LWP, HARDLEN 15-LP, HARDLEN 15-LLP, HARDLEN 16-LP, HARDLEN DX-526P, HARDLEN CY-9122P, HARDLEN CY-9124P, HARDLEN HM-21P, HARDLEN M-28P, HARDLEN F-2P, HARDLEN F-6P, TOYO-TAC M-100, TOYO-TAC M-300, TOYO-TAC M-312, TOYO-TAC PMA H1000P, and TOYO-TAC PMA-F2, manufactured by TOYOBO CO., LTD.; SUPERCHLON C, SUPERCHLON L-206, SUPERCHLON 813A, SUPERCHLON 803M, SUPERCHLON 803MW, SUPERCHLON 803LT, SUPERCHLON 1026, SUPERCHLON 803L, SUPERCHLON 814H, SUPERCHLON 390S, SUPERCHLON 814B, SUPERCHLON 360T, SUPERCHLON 370M, SUPERCHLON 2027MB, SUPERCHLON 822, SUPERCHLON 892L, SUPERCHLON 930, SUPERCHLON 842LM, and SUPERCHLON 851L, manufactured by NIPPON PAPER INDUSTRIES CO., LTD.; X-10065, X-10088, X-10082, X-10087, X-10053, and X-10052, manufactured by Baker Hughes, and the like.

The melting point of the dispersant X is 34° C. or higher, preferably 50° C. or higher, more preferably 65° C. or higher, and even more preferably 80° C. or higher, from the viewpoint of adhesiveness to a film, and the melting point is preferably 150° C. or lower, more preferably 140° C. or lower, and even more preferably 130° C. or lower, from the viewpoint of dispersibility of the toner particles.

The content of the dispersant X is preferably 80% by mass or more, more preferably 90% by mass or more, even more preferably 95% by mass or more, and even more preferably 100% by mass, of the dispersant.

The dispersant other than the dispersant X includes copolymers of alkyl methacrylate/amino group-containing methacrylate, copolymers of α-olefin/vinyl pyrrolidone (Antaron V-216), and the like.

The content of the dispersant X, based on 100 parts by mass of a total amount of the resin binder and the colorant, is preferably 0.1 parts by mass or more, more preferably 1 part by mass or more, and even more preferably 2 parts by mass or more, from the viewpoint of dispersibility of the toner particles and adhesiveness to a film, and the content is preferably 20 parts by mass or less, more preferably 15 parts by mass or less, and even more preferably 10 parts by mass or less, from the viewpoint of chargeability of the toner particles.

[Insulating Liquid]

The insulating liquid in the present invention means a liquid through which electricity is less likely to flow, and in the present invention, the conductivity of the insulating liquid is preferably $1.0\times10^{-11}$ S/m or less, and more preferably $5.0\times10^{12}$ S/m or less, and preferably $1.0\times10^{-13}$ S/m or more.

It is preferable that the insulating liquid in the liquid developer of the present invention is an insulating liquid containing a polyisobutene, from the viewpoint of dispersion stability and chargeability.

The polyisobutene in the present invention refers to a compound obtained by polymerizing isobutene in accordance with a known method, for example, a cationic polymerization method using a catalyst, and thereafter hydrogenating the polymer at a terminal double bond.

The catalyst usable in the cationic polymerization method includes, for example, aluminum chloride, an acidic ion-exchanging resin, sulfuric acid, boron fluoride, and complexes thereof, and the like. In addition, the polymerization reaction can be controlled by adding a base to the above catalyst.

The degree of polymerization of the polyisobutene is preferably 8 or less, more preferably 6 or less, even more preferably 5 or less, even more preferably 4 or less, and even more preferably 3 or less, from the viewpoint of improving low-temperature fusing ability of the toner, and the degree of polymerization is preferably 2 or more, and more preferably 3 or more, from the viewpoint of controlling corona charger contamination.

It is preferable that an unreacted component of isobutene caused during the polymerization reaction or a high-boiling point component having a high degree of polymerization is removed by distillation. The method of distillation includes, for example, a simple distillation method, a continuous distillation method, a steam distillation method, and the like, and these methods can be used alone or in a combination. The apparatuses used in distillation are not particularly limited to in materials, shapes, models, and the like, which include, for example, a distillation tower packed with a filler material such as Raschig ring, shelved distillation towers comprising dish-shaped shelves, and the like. In addition, the theoretical number of shelves showing separating ability of the distillation tower is preferably 10 shelves or more. Besides, as to conditions such as feeding rates to the distillation tower, refluxing ratios, and uptake amounts, the conditions can be appropriately selected depending upon the distillation apparatuses.

Since a formed product obtained by the polymerization reaction has a double bond at a polymerization terminal, a hydrogenated compound is obtained by a hydrogenation reaction. The hydrogenation reaction can be carried out by, for example, contacting with hydrogen under a pressure of from 2 to 10 MPa at a temperature of from 180° to 230° C. using a hydrogenation catalyst such as nickel or palladium.

The boiling point of the polyisobutene is preferably 120° C. or higher, more preferably 140° C. or higher, and even more preferably 160° C. or higher, from the viewpoint of even more improving dispersion stability of the toner particles, thereby improving storage stability, and the boiling point is preferably 300° C. or lower, more preferably 280° C. or lower, and even more preferably 260° C. or lower, from the viewpoint of even more improving low-temperature fusing ability of the liquid developer, and from the viewpoint of even more improving pulverizability of the toner during wet-milling, thereby providing a liquid developer having a smaller particle size.

The content of the polyisobutene is preferably 5% by mass or more, more preferably 20% by mass or more, even more preferably 40% by mass or more, even more preferably 60% by mass or more, and even more preferably 80% by mass or more, of the insulating liquid, from the viewpoint of controlling corona charger contamination.

Commercially available products of the insulating liquid containing a polyisobutene include "NAS-3," "NAS-4," "NAS-5H," hereinabove manufactured by NOF Corporation, and the like. Among them, the commercially available products can be used alone or in a combination of two or more kinds.

Specific examples of the insulating liquid other than the polyisobutene include, for example, aliphatic hydrocarbons, alicyclic hydrocarbons, aromatic hydrocarbons, halogenated hydrocarbons, polysiloxanes, vegetable oils, and the like. Among them, the aliphatic hydrocarbons such as liquid paraffin and isoparaffin are preferred, from the viewpoint of lowering the viscosity of the liquid developer, and from the viewpoint of odor, harmlessness, and costs.

Commercially available products of the aliphatic hydrocarbon include Isopar L and Isopar M, manufactured by Exxon Mobile Corporation; Lytol, manufactured by Sonneborn; Cactus N12D and Cactus N14, manufactured by JX Nippon Oil & Energy Corporation, and the like.

The boiling point of the insulating liquid is preferably 120° C. or higher, more preferably 140° C. or higher, and even more preferably 160° C. or higher, from the viewpoint of even more improving dispersion stability of the toner particles, thereby improving storage stability, and the boiling point is preferably 300° C. or lower, more preferably 280° C. or lower, and even more preferably 260° C. or lower, from the viewpoint of even more improving low-temperature fusing ability of the toner, and from the viewpoint of even more improving pulverizability of the toner during wet-milling, thereby providing toner particles having smaller particle sizes. When the insulating liquids are used in combination of two or more kinds, it is preferable that a boiling point of a combined insulating liquid mixture is within the above range.

The viscosity of the insulating liquid at 25° C. is preferably 1 mPa·s or more, from the viewpoint of improving developing ability and from the viewpoint of improving storage stability of the toner particles in the liquid developer, and the viscosity is preferably 100 mPa·s or less, more preferably 50 mPa·s or less, even more preferably 20 mPa·s or less, even more preferably 10 mPa·s or less, and even more preferably 5 mPa·s or less.

The liquid developer may properly contain, in addition to the resin binder, the colorant, the dispersant, and the insulating liquid, an additive such as a releasing agent, a charge control agent, a charge control resin, a magnetic particulate, a fluidity improver, an electric conductivity modifier, a reinforcing filler such as a fibrous material, an antioxidant, or a cleanability improver.

The liquid developer of the present invention is obtained by mixing toner particles containing a resin binder and a colorant, a dispersant, and an insulating liquid, or mixing toner particles containing a resin binder, a colorant, and a dispersant, and an insulating liquid.

The methods for producing toner particles include:

a method including melt-kneading toner raw materials containing a resin binder and a colorant, and pulverizing, preferably wet-milling, a melt-kneaded product obtained (a production method A);

a method including powdering raw materials containing a resin binder in an aqueous medium (a production method B);

a method including stirring an aqueous resin binder dispersion and a colorant at a high speed (production method C), and the like.

In the present invention, the production method A is preferred, from the viewpoint of availability of the usable materials, and the production method B is preferred, from the viewpoint of giving a function to a resin having an acidic group.

(Production Method A)

First, it is preferable that the toner raw materials containing a resin binder, a colorant, optionally used additives and the like are previously mixed with a mixer such as a Henschel mixer, a Super mixer or a ball-mill, and the mixture is then fed to a kneader, and the Henschel mixer is more preferred, from the viewpoint of improving colorant dispersibility in the resin binder. Here, the dispersant may be mixed and used together with the toner raw materials such as a resin binder.

The mixing with a Henschel mixer is carried out while adjusting a peripheral speed of agitation, and agitation time. The peripheral speed is preferably 10 msec or more and 30 msec or less, from the viewpoint of improving colorant dispersibility. In addition, the agitation time is preferably 1 minute or more and 10 minutes or less, from the viewpoint of improving colorant dispersibility.

Next, the melt-kneading of toner raw materials can be carried out with a known kneader, such as a tightly closed kneader, a single-screw or twin-screw kneader, or a continuous open-roller type kneader. In the method for production of the present invention, an open-roller type kneader is preferred, from the viewpoint of improving colorant dispersibility, and from the viewpoint of improving an yield of the toner particles after pulverization.

The open-roller type kneader refers to a kneader of which melt-kneading unit is an open type, not being tightly closed, which can easily dissipate the kneading heat generated during the melt-kneading. The open-roller type kneader used in the present invention is provided with a plurality of feeding ports for raw materials and a discharging port for a kneaded mixture along the shaft direction of the roller, and it is preferable that the open-roller type kneader is a continuous open-roller type kneader, from the viewpoint of production efficiency.

It is preferable that the open-roller type kneader comprises at least two kneading rollers having different temperatures.

It is preferable that the setting temperatures of the rollers are such that the set temperature is equal to or lower than a temperature that is 10° C. higher than the softening point of the resin, from the viewpoint of improving miscibility of the toner raw materials.

In addition, it is preferable that the set temperature of the roller at an upstream side is higher than the set temperature of the roller at a downstream side, from the viewpoint of making the adhesiveness of the kneaded product to the roller at an upstream side favorable and strongly kneading at a downstream side.

It is preferable that the rollers have peripheral speeds that are different from each other. In the open roller-type kneader provided with the above two rollers, it is preferable that the heat roller having a higher temperature is a high-rotation roller, and that the cooling roller having a lower temperature is a low-rotation roller, from the viewpoint of improving fusing ability of the liquid developer.

The peripheral speed of the high-rotation roller is preferably 2 m/min or more, and more preferably 5 m/min or more, and preferably 100 m/min or less, and more preferably 75 m/min or less. The peripheral speed of the low-rotation roller is preferably 2 m/min or more, and more preferably 4 m/min or more, and preferably 100 m/min or less, more preferably 60 m/min or less, and even more preferably 50 m/min or less. Also, the ratio of the peripheral speeds of the two rollers, i.e. low-rotation roller/high-rotation roller, is preferably 1/10 or more, and more preferably 3/10 or more, and preferably 9/10 or less, and more preferably 8/10 or less.

In addition, structures, size, materials and the like of each of the rollers are not particularly limited. The surface of the roller comprises a groove used in kneading, and the shapes of grooves include linear, spiral, wavy, rugged or other forms.

Next, the melt-kneaded product is cooled to an extent that is pulverizable, and the cooled product is subjected to a pulverizing step and optionally a classifying step, whereby the toner particles can be obtained.

The pulverizing step may be carried out in divided multi-stages. For example, the melt-kneaded product may be roughly pulverized to a size of from 1 to 5 mm or so, and the roughly pulverized product may then be further finely pulverized. In addition, in order to improve productivity during the pulverizing step, the melt-kneaded product may be mixed with fine inorganic particles made of hydrophobic silica or the like, and then pulverized.

The pulverizer suitably used in the rough pulverization includes, for example, an atomizer, Rotoplex, and the like, or a hammer-mill or the like may be used. In addition, the pulverizer suitably used in the fine pulverization includes a fluidised bed opposed jet mill, an air jet mill, a mechanical mill, and the like.

The classifier usable in the classification step includes an air classifier, a rotor type classifier, a sieve classifier, and the like. Here, the pulverizing step and the classifying step may be repeated as occasion demands.

The toner particles obtained in the production method A have a volume-median particle size $D_{50}$ of preferably 3 μm or more, and more preferably 4 μm or more, and preferably 15 μm or less, and more preferably 12 μm or less, from the viewpoint of improving productivity of the wet-milling step described later. Here, the volume-median particle size $D_{50}$ means a particle size of which cumulative volume frequency calculated on a volume percentage is 50% counted from the smaller particle sizes. Here, it is preferable that the toner particles are mixed with a dispersant and an insulating liquid, and then further finely pulverized with wet-milling or the like.

(Production Method B)

The production method B includes, for example:

(B1) a method including previously forming primary particles containing a resin binder in an aqueous medium, and thereafter aggregating and unifying the primary particles;

(B2) a method including previously forming primary particles containing a resin binder in an aqueous medium, and thereafter fusing the primary particles; and (B3) a method including dispersing raw materials containing a resin binder in an aqueous medium, and powdering the dispersion, and the like.

In the present invention, the method (B1) is preferred, and a method including (1) introducing an aqueous medium to a mixed solution or dispersion prepared by dissolving or dispersing raw materials containing a resin binder in an organic solvent, and thereafter removing the organic solvent, to provide an aqueous dispersion of primary particles containing a resin binder; and (2) aggregating and unifying the primary particles is preferred. Specific examples of the method (B2) include a method including subjecting a radical-polymerizable monomer solution in which a resin binder is dissolved to an emulsion polymerization to provide fine resin particles, and fusing the fine resin particles obtained in an aqueous medium (see, Japanese Patent Laid-Open No. 2001-42568), and specific examples of the method (B3) include a method including heating and melting raw materials containing a resin binder, dispersing the molten raw materials in an aqueous medium without containing an organic solvent, while maintaining the molten state of the resin binder, and subsequently drying the dispersion (see, Japanese Patent Laid-Open No. 2001-235904), and the like, respectively.

The step (1) is a step of introducing an aqueous medium to a mixed solution or dispersion prepared by dissolving or dispersing raw materials containing a resin binder in an organic solvent, and thereafter removing the organic solvent, to provide an aqueous dispersion of primary particles containing a resin binder.

The amount of the organic solvent used is preferably 100 parts by mass or more and 1,000 parts by mass or less, based on 100 parts by mass of the resin binder. Water and optionally a neutralizing agent is mixed with stirring with a mixed solution, and the organic solvent is removed from the dispersion obtained, whereby an aqueous dispersion of primary particles of a self-dispersible resin can be obtained. The organic solvent includes those mentioned above.

The amount of the aqueous solvent used is preferably 100 parts by mass or more and 3,000 parts by mass or less, based on 100 parts by mass of the organic solvent. Here, the aqueous medium usable in the method (1) may contain a solvent such as an organic solvent, and water is contained in an amount of preferably 50% by mass or more, preferably 70% by mass or more, more preferably 90% by mass or more, and even more preferably 99% by mass or more.

When a mixture is agitated, a mixing agitator generally used such as anchor blades can be used. The neutralizing agent includes alkali metal compounds such as lithium hydroxide, sodium hydroxide, and potassium hydroxide; organic bases such as ammonia, trimethylamine, ethylamine, diethylamine, triethylamine, triethanolamine, and tributylamine. The amount of the neutralizing agent, based on the acid value of the polyester after the reaction used in neutralization, is preferably 0.5 equivalents or more, more preferably 0.7 equivalents or more, and even more preferably 0.8 equivalents or more, and 1.5 equivalents or less, more preferably 1.3 equivalents or less, and even more preferably 1.2 equivalents or less.

For the intended purposes of lowering the melt viscosity and the melting point of the resin binder, and improving dispersibility of produced primary particles, a dispersant can be used. The dispersant includes, for example, water-soluble polymers such as polyvinyl alcohols, methyl cellulose, ethyl cellulose, hydroxyethyl cellulose, carboxymethyl cellulose, sodium polyacrylate, and sodium polymethacrylate; anionic surfactants such as sodium dodecylbenzenesulfonate, sodium octadecylsulfate, sodium oleate, sodium laurate, and potassium stearate; cationic surfactants such as laurylamine acetate, stearylamine acetate, and lauryltrimethylammonium chloride; amphoteric surfactants such as lauryldimethylamine oxide; and inorganic salts such as calcium phosphate, aluminum hydroxide, calcium sulfate, and calcium carbonate. The amount of the dispersant used, based on 100 parts by mass of the resin binder, is preferably 20 parts by mass or less, more preferably 15 parts by mass or less, and even more preferably 10 parts by mass or less, from the viewpoint of emulsion stability and detergency.

The solid content concentration of the primary particles containing a resin binder obtained by the step (1) (hereinafter also simply referred to as primary particles) is preferably 7% by mass or more, and preferably 50% by mass or less, and more preferably 40% by mass or less, of the dispersion, from the viewpoint of stability of the dispersion and handling of the dispersion in the aggregating step. Here, the solid content includes a non-volatile component such as resins.

The average particle size of the primary particles is preferably 0.05 μm or more, and preferably 3 μm or less, more preferably 1 μm or less, and even more preferably 0.8 μm or less, from the viewpoint of uniformly aggregating the primary particles in the subsequent step. In the present invention, the average particle size of the primary particles refers to a volume-median particle size $D_{50}$, and can be measured with a laser diffraction particle size analyzer or the like.

Subsequently, the step of aggregating and unifying the primary particles obtained in the step (1) (step (2)) will be explained.

In the step (2), the solid content concentration in the system in the aggregating step of aggregating the primary particles obtained in the step (1) can be adjusted by adding water to the dispersion of a resin binder, and the solid content concentration is preferably 5% by mass or more, and preferably 50% by mass or less, more preferably 30% by mass or less, and even more preferably 20% by mass or less, in order to cause uniform aggregation.

The pH inside the system in the aggregating step is preferably 2 or more, and preferably 10 or less, and more preferably 9 or less, from the viewpoint of satisfying dispersion stability of the liquid mixture and aggregating ability of fine particles of a resin binder and the like.

It is preferable that the temperature inside the system in the aggregating step is a temperature of equal to or higher than a temperature calculated as a softening point of the resin binder minus 80° C. and a temperature equal to or lower than the softening point, from the same viewpoint.

In addition, the additive such as a colorant may be previously mixed with a resin binder when the primary particles are prepared, or a dispersion is prepared by separately dispersing each of additives in a dispersion medium such as water, each of the dispersions is mixed with the primary particles to be subjected to an aggregating step. When an additive is previously mixed with a resin binder when the primary particles are prepared, it is preferable that a resin binder and an additive are previously melt-kneaded.

In the aggregating step, an aggregating agent can be added in order to effectively carry out the aggregation. As the aggregating agent, a cationic surfactant of a quaternary salt, a polyethylencimine or the like in an organic system, or an inorganic ammonium salt, an inorganic metal salt, a divalent or higher polyvalent metal complex or the like in an inorganic system is used. The inorganic ammonium salt includes ammonium sulfate, ammonium chloride, and the like. The inorganic metal salt includes metal salts such as sodium sulfate, sodium chloride, calcium chloride, calcium nitrate, barium chloride, magnesium chloride, zinc chloride, aluminum chloride and aluminum sulfate; polymers of inorganic metal salts such as poly(aluminum chloride), poly(aluminum hydroxide), and poly(calcium sulfide), and the like.

The amount of the aggregating agent used, is preferably 50 parts by mass or less, and more preferably 40 parts by mass or less, based on 100 parts by mass of the resin binder, from the viewpoint of environmental resistance property of the toner.

Subsequently, the aggregated particles containing at least a resin binder obtained in the above aggregating step are heated and unified (unifying step).

The temperature inside the system in the unifying step is preferably from a temperature equal to or higher than a temperature calculated as a softening point of the resin binder minus 50° C. to a temperature equal to or lower than a temperature calculated as a softening point plus 10° C., more preferably from a temperature equal to or higher than a temperature calculated as a softening point minus 45° C. to a temperature equal to or lower than a temperature calculated as a softening point plus 10° C., and even more preferably from a temperature equal to or higher than a temperature calculated as a softening point minus 40° C. to a temperature equal to or lower than a temperature calculated as a softening point plus 10° C., from the viewpoint of particle sizes, the particle size distribution, the shape control, and fusibility of the particles of the toner. In addition, it is preferable that the agitation rate is a rate at which the aggregated particles do not precipitate. Here, in the present invention, when two or more kinds of resins are used as resin binders, a softening point of a mixed resin is defined as a softening point of the resin binder.

In the aggregating step, a nonionic surfactant may be used, from the viewpoint of improving productivity, and an anionic surfactant may be used, from the viewpoint of dispersibility of the toner, respectively.

The unified particles obtained by the step (2) are appropriately subjected to a liquid-solid separation step such as filtration, a washing step, and a drying step, whereby toner particles can be obtained.

In addition, in the drying step, any methods such as vibrating fluidized bed drying method, spray-drying method, freeze-drying method, or flush-jet method can be employed.

The volume-median particle size $D_{50}$ of the toner particles obtained in the production method B is preferably 0.5 μm or more, more preferably 1.0 μm or more, and even more preferably 1.5 μm or more, from the viewpoint of lowering the viscosity of the liquid developer, and the volume-median particle size is preferably 5 μm or less, more preferably 3 μm or less, and even more preferably 2.5 μm or less, from the viewpoint of improving image quality of the liquid developer.

The content of the toner particles, based on 100 parts by mass of the insulating liquid, is preferably 10 parts by mass or more, more preferably 20 parts by mass or more, even more preferably 30 parts by mass or more, even more preferably 40 parts by mass or more, and even more preferably 50 parts by mass or more, from the viewpoint of high-speed printability, and the content is preferably 100 parts by mass or less, more preferably 80 parts by mass or less, even more preferably 70 parts by mass or less, and even more preferably 60 parts by mass or less, from the viewpoint of improving dispersion stability.

As the method for mixing toner particles, a dispersant, and an insulating liquid, or mixing toner particles and an insulating liquid, a method including stirring the components with an agitation mixer or the like is preferred.

The agitation mixer is, but not particularly limited to, preferably high-speed agitation mixers, from the viewpoint of improving productivity and storage stability of the dispersion of toner particles. Specific examples are preferably DESPA, manufactured by ASADA IRON WORKS CO., LTD.; T.K. HOMOGENIZING MIXER, T.K. HOMOGENIZING DISPER, T.K. ROBOMIX, hereinabove manufactured by PRIMIX Corporation; CLEARMIX, manufactured by M Technique Co., Ltd.; KADY Mill, manufactured by KADY International, and the like.

The toner particles are previously dispersed by mixing components with a high-speed agitation mixer, whereby a dispersion of toner particles can be obtained, which in turn improves productivity of a liquid developer by the subsequent wet-milling.

The solid content concentration of the liquid developer is preferably 10% by mass or more, more preferably 15% by mass or more, and even more preferably 20% by mass or more, from the viewpoint of improving optical density, and the solid content concentration is preferably 50% by mass or less, more preferably 45% by mass or less, and even more preferably 40% by mass or less, from the viewpoint of improving dispersion stability of the toner particles, thereby improving storage stability.

As always provided, it is preferable that the liquid developer is obtained by dispersing toner particles obtained in the production method A in an insulating liquid, and thereafter wet-milling a dispersion, from the viewpoint of making particle sizes of the toner particles in the liquid developer smaller, and from the viewpoint of lowering the viscosity of the liquid developer.

Further, when wet-milling is carried out, the solid content concentration of the dispersion of the toner particles obtained by mixing toner particles, a dispersant, and an insulating liquid is preferably 20% by mass or more, more preferably 30% by mass or more, and even more preferably 33% by mass or more, from the viewpoint of improving optical density, and the solid content concentration is preferably 50% by mass or less, more preferably 45% by mass or less, and even more preferably 40% by mass or less, from the viewpoint of improving dispersion stability of the toner particles, thereby improving storage stability.

The wet-milling refers to a method of subjecting toner particles dispersed in an insulating liquid to a mechanical milling treatment in the state of dispersion in the insulating liquid.

As the apparatus used, for example, generally used agitation mixers such as anchor blades can be used. Among the agitation mixers, the apparatuses include high-speed agitation mixers such as DESPA, manufactured by ASADA IRON WORKS CO., LTD., and T.K. HOMOGENIZING MIXER, manufactured by PRIMIX Corporation; pulverizers or kneaders, such as roller mills, beads-mills, kneaders, and extruders; and the like. These apparatuses can be used in a combination of plural apparatuses.

Among these apparatuses, use of beads-mill is preferred, from the viewpoint of making particle sizes of toner particles smaller, from the viewpoint of improving dispersion stability of the toner particles, thereby improving storage stability, and from the viewpoint of lowering the viscosity of the dispersion.

By controlling particle sizes and filling ratios of media used, peripheral speeds of rotors, residence time, or the like in the beads-mill, toner particles having a desired particle size and a particle size distribution can be obtained.

As described above, in a case where a liquid developer is obtained by producing toner particles according to the production method A, and further wet-milling the toner particles, it is preferable that the liquid developer of the present invention is produced by a method including:

step 1: melt-kneading a resin binder containing a polyester-based resin and a colorant, and pulverizing a kneaded product obtained, to provide toner particles;

step 2: adding a dispersant to the toner particles obtained in the step 1, and dispersing the toner particles in an insulating liquid to provide a dispersion of toner particles; and step 3: subjecting the dispersion of toner particles obtained in the step 2 to wet-milling, to provide a liquid developer.

The solid content concentration of the liquid developer obtained by wet-milling is preferably 10% by mass or more, more preferably 15% by mass or more, and even more preferably 20% by mass or more, from the viewpoint of improving optical density, and the solid content concentration is preferably 50% by mass or less, more preferably 45% by mass or less, and even more preferably 40% by mass or less, from the viewpoint of improving dispersion stability of the toner particles, thereby improving storage stability.

The volume-median particle size $D_{50}$ of the toner particles in the liquid developer is preferably 0.5 μm or more, more preferably 1.0 μm or more, and even more preferably 1.5 μm or more, from the viewpoint of lowering the viscosity of the liquid developer, and the volume-median particle size is preferably 5 μm or less, more preferably 3 μm or less, and even more preferably 2.5 μm or less, from the viewpoint of improving image quality of the liquid developer.

The viscosity of the liquid developer, the solid content concentration of which is 25% by mass, at 25° C. is preferably 1 mPa·s or more, more preferably 2 mPa·s or more, and even more preferably 3 mPa·s or more, from the viewpoint of developability, and the viscosity is preferably 50 mPa·s or less, more preferably 40 mPa·s or less, and even more preferably 30 mPa·s or less, from the viewpoint of high-speed printing.

By using the liquid developer of the present invention, a fused image can be printed on a resin film. As the resin film, a polyethylene terephthalate film can be used. In addition, in a case where of a liquid developer containing a dispersant X of which dispersible group has a polypropylene backbone, excellent fusing ability is exhibited even with a polypropylene film. Also, in a case where a resin having an acidic group is a modified polyester having a urethane bond, excellent fusing ability is exhibited even with a nylon film.

Specific methods for printing a fused image on a resin film using a liquid developer include, for example, a method including charging step of charging a photoconductor; an exposing step of exposing a photoconductor; a developing step of adhering toner particles in a liquid developer to an electrostatic latent image formed on the photoconductor to form a toner image; a transferring step of transferring the formed toner image to a resin film; and a fusing step of heating a transferred toner image to evaporate and remove an insulating liquid contained in the toner image, and at the same time fusing the toner image on the resin film.

Here, the liquid developer of the present invention can be favorably fused also to an untreated resin film. Therefore, since the pretreatment (application of surface-modifying agent) of the resin film which has been conventionally carried out is not necessitated upon image printing to a resin film, large-scaled printing apparatus and complications of the system can be avoided by using the liquid developer of the present invention. In addition, high-image quality formation of the fused images can be accomplished.

With regard to the embodiments described above, the present invention further discloses the following liquid developers and methods for producing a liquid developer.

<1> A liquid developer containing a resin binder, a colorant, a dispersant, and an insulating liquid, wherein the resin binder contains a resin having an acidic group, and wherein the dispersant contains a dispersant X having at least one basic nitrogen-containing group selected from the group consisting of an amino group, an imino group, a cyano group, an azo group, a diazo group, and an azide group, and wherein a melting point of the dispersant X is 34° C. or higher.

<2> The liquid developer according to the above <1>, wherein the resin having an acidic group is a polyester-based resin.

<3> The liquid developer according to the above <2>, wherein the polyester-based resin is a polyester resin or a composite resin containing a polyester resin and a styrenic resin.

<4> The liquid developer according to the above <3>, wherein the polyester resin is a polycondensate of an alcohol component containing a dihydric or higher polyhydric alcohol and a carboxylic acid component containing a dicarboxylic or higher polycarboxylic acid compound.

<5> The liquid developer according to the above <4>, wherein the dihydric or higher polyhydric alcohol contains an aliphatic diol having 2 or more carbon atoms and 20 or less carbon atoms, and preferably 2 or more carbon atoms and 15 or less carbon atoms and/or an alkylene oxide adduct of bisphenol A represented by the formula (I).

<6> The liquid developer according to any one of the above <1> to <5>, wherein the melting point of the dispersant X is 34° C. or higher, preferably 50° C. or higher, more preferably 65° C. or higher, and even more preferably 80° C. or higher, and 150° C. or lower, preferably 140° C. or lower, and more preferably 130° C. or lower.

<7> The liquid developer according to any one of the above <1> to <6>, wherein the basic nitrogen-containing group in the dispersant X is an imino group and/or an amino group.

<8> The liquid developer according to any one of the above <1> to <7>, wherein the dispersant X is obtained by reacting raw materials for a basic nitrogen-containing group and raw materials for a dispersible group.

<9> The liquid developer according to the above <8>, wherein the number-average molecular weight of the raw materials for the basic nitrogen-containing group is 100 or more, preferably 500 or more, and more preferably 1,000 or more, and 15,000 or less, preferably 10,000 or less, and even more preferably 5,000 or less.

<10> The liquid developer according to any one of the above <1> to <9>, wherein the dispersant X contains a group derived from at least one member selected from the group consisting of hydrocarbons having 16 or more carbon atoms, hydrocarbons having 16 or more carbon atoms partly substituted with a halogen atom, hydrocarbons having 16 or more carbon atoms having a reactive functional group, a polymer of a hydroxycarboxylic acid having 16 or more carbon atoms, a polymer obtained from a dibasic acid having 2 or more carbon atoms and 22 or less carbon atoms and a diol having 2 or more carbon atoms and 22 or less carbon atoms, a polymer of an alkyl (meth)acrylate having 16 or more carbon atoms, and a polyolefin.

<11> The liquid developer according to any one of the above <1> to <10>, wherein the boiling point of the insulating liquid is 120° C. or higher, preferably 140° C. or higher, and more preferably 160° C. or higher, and 300° C. or lower, preferably 280° C. or lower, and more preferably 260° C. or lower.

<12> The liquid developer according to any one of the above <1> to <11>, wherein the viscosity of the insulating liquid at 25° C. is 1 mPa·s or more, and 100 mPa·s or less, preferably 50 mPa·s or less, more preferably 20 mPa·s or less, even more preferably 10 mPa·s or less, and even more preferably 5 mPa·s or less.

<13> The liquid developer according to any one of the above <1> to <12>, wherein the insulating liquid contains a polyisobutene.

<14> The liquid developer according to the above <13>, wherein the degree of polymerization of the polyisobutene is 2 or more, and preferably 3 or more, and 8 or less, preferably 6 or less, more preferably 5 or less, even more preferably 4 or less, and even more preferably 3 or less.

<15> The liquid developer according to the above <13> or <14>, wherein the boiling point of the polyisobutene is 120° C. or higher, preferably 140° C. or higher, and more preferably 160° C. or higher, and 300° C. or lower, preferably 280° C. or lower, and more preferably 260° C. or lower.

<16> The liquid developer according to any one of the above <1> to <15>, wherein the dispersant X comprises a polyethylene backbone and/or a polypropylene backbone.

<17> The liquid developer according to any one of the above <1> to <16>, wherein the resin having an acidic group is a modified polyester resin having a urethane bond.

<18> A method for printing a fused image on a resin film using a liquid developer as defined in any one of the above <1> to <17>, wherein the above resin film is a polyethylene terephthalate film.

<19> A method for printing a fused image on a resin film using a liquid developer as defined in the above <16> or <17>, wherein the resin film is a polypropylene film.

<20> A method for printing a fused image on a resin film using a liquid developer as defined in the above <17>, wherein the resin film is a nylon film.

The present invention will be described hereinbelow more specifically by the Examples, without intending to limit the present invention to these Examples. The physical properties of the resins and the like were measured in accordance with the following methods.

[Softening Point of Resin and Toner Particles]

Using a flow tester "CFT-500D," manufactured by Shimadzu Corporation, a 1 g sample is extruded through a nozzle having a diameter of 1 mm and a length of 1 mm with applying a load of 1.96 MPa thereto with a plunger, while heating the sample at a heating rate of 6° C./min. The softening point refers to a temperature at which half of the sample flows out, when plotting a downward movement of the plunger of the flow tester against temperature.

[Glass Transition Temperature of Resin and Toner Particles]

Using a differential scanning calorimeter "Q20," manufactured by TA Instruments, a 0.01 to 0.02 g sample is weighed out in an aluminum pan, heated to 200° C., and cooled from that temperature to 0° C. at a cooling rate of 10° C./min. Next, the temperature of the sample is raised at a heating rate of 10° C./min to measure endothermic peaks. A temperature of an intersection of the extension of the baseline of equal to or lower than the highest temperature of endothermic peak and the tangential line showing the maximum inclination between the kick-off of the peak and the top of the peak is defined as a glass transition temperature.

[Acid Value of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Volume-Median Particle Size $D_{50}$ and CV Value of Resin Particles and Colorant Particles]

(1) Measuring Apparatus: Laser diffraction particle size analyzer "LA-920" manufactured by HORIBA, Ltd.

(2) Measurement Conditions: To the measurement cell is added distilled water, and a volume-median particle size is measured at a temperature where the absorbance is within an appropriate range.

In addition, a CV value (%) is calculated in accordance with the following formula:

$$CV\ \text{Value}\ (\%) = \frac{\text{Standard Deviation of Particle Size Distribution}}{\text{Volume-Median particle Size } D_{50}} \times 100$$

[Solid Content Concentration of Aqueous Dispersion of Resin]

The water content is measured using an infrared moisture determination balance "FD-230" manufactured by Kett Electric Laboratory using a 5 g measurement sample at a drying temperature of 150° C. with a measurement mode 96 (monitoring time: 2.5 min/fluctuation width: 0.05%). The solid content concentration is calculated in accordance with the following formula:

$$\text{Solid Content Concentration (\% by Mass)} = 100 - M$$

wherein M is a water content (% by mass).

[Volume-Median Particle Size of Toner Particles Before Mixing With Insulating Liquid]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic Solution: Isotone II, manufactured by Beckman Coulter, Inc.

Dispersion: EMULGEN 109P, manufactured by Kao Corporation, polyoxyethylene lauryl ether, HLB (Griffin): 13.6, is dissolved in the above electrolytic solution to adjust to a concentration of 5% by mass to provide a dispersion.

Dispersion Conditions: Ten milligrams of a measurement sample is added to 5 mL of the above dispersion, and the mixture is dispersed for 1 minute with an ultrasonic disperser (name of machine: US-1, manufactured by SND Co., Ltd., output: 80 W), and 25 mL of the above electrolytic solution is then added to the dispersion, and further dispersed with the ultrasonic disperser for 1 minute, to prepare a sample dispersion.

Measurement Conditions: The above sample dispersion is added to 100 mL of the above electrolytic solution to adjust to a concentration at which particle sizes of 30,000 particles can be measured in 20 seconds, and the 30,000 particles are measured, and a volume-median particle size $D_{50}$ is obtained from the particle size distribution.

[Number-Average Molecular Weight of Raw Materials for Basic Nitrogen-Containing Group]

The number-average molecular weight is obtained by measuring a molecular weight distribution in accordance with a gel permeation chromatography (GPC) method as shown hereinbelow.

(1) Preparation of Sample Solution

A polyalkyleneimine is dissolved in a solution prepared by dissolving $Na_2SO_4$ in an aqueous 1% acetic acid solution at 0.15 mol/L so as to have a concentration of 0.2 g/100 mL. Next, this solution is filtered with a fluororesin filter "FP-200," manufactured by Sumitomo Electric Industries, Ltd., having a pore size of 0.2 μm, to remove insoluble components, to provide a sample solution.

(2) Molecular Weight Measurements

Using the following measurement apparatus and analyzing column, the measurement is taken by allowing a solution prepared by dissolving $Na_2SO_4$ in an aqueous 1% acetic acid solution at 0.15 mol/L to flow through a column as an eluent at a flow rate of 1 mL per minute, stabilizing the column in a thermostat at 40° C., and loading 100 μL of a sample solution thereto. The molecular weight of the sample is calculated based on the previously drawn calibration curve. At this time, a calibration curve which is drawn from several kinds of standard pullulans, manufactured by SHOWA DENKO CORPORATION, P-5 (Mw $5.9\times10^3$), P-50 (Mw $4.73\times10^4$), P-200 (Mw $2.12\times10^5$), and P-800 (Mw $7.08\times10^5$) as standard samples is used. The values within the parentheses show molecular weights.

Measurement Apparatus: HLC-8320GPC, manufactured by Tosoh Corporation Analyzing Column; α+α−M+α−M, manufactured by Tosoh Corporation.

[Melting Points of Raw Materials for Dispersible Group and Dispersant]

Using a differential scanning calorimeter "Q20," manufactured by TA Instruments, a 0.01 to 0.02 g sample is weighed out in an aluminum pan, and cooled from room temperature to −50° C. at a cooling rate of 10° C./min. Next, the temperature of the sample is raised from −50° to 200° C. at a heating rate of 10° C./min to measure endothermic peaks. The top of the peak of the endothermic peak is defined as a melting point.

[Boiling Point of Insulating Liquid]

Using a differential scanning calorimeter "DSC210," manufactured by Seiko Instruments Inc., a 6.0 to 8.0 g sample is weighed out in an aluminum pan, the temperature of the sample is raised to 350° C. at a heating rate of 10° C./min to measure endothermic peaks. The highest temperature side of the endothermic peak is defined as a boiling point.

[Conductivity of Insulating Liquid]

A 40 mL glass sample vial "Vial with screw cap, No. 7," manufactured by Maruemu Corporation is charged with 25 g of an insulating liquid. The conductivity is determined by immersing an electrode in an insulating liquid, taking 20 measurements for conductivity at 25° C. with a non-aqueous conductivity meter "DT-700," manufactured by Dispersion Technology, Inc., and calculating an average thereof. The smaller the numerical figures, the higher the resistance.

[Viscosities at 25° C. of Insulating Liquid and Liquid Developer Solid Content Concentration of Which Is 25% by Mass]

A 10-mL glass sample vial with screw cap is charged with 6 to 7 mL of a measurement solution, and a viscosity at 25° C. is measured with a torsional oscillation type viscometer "VISCOMATE VM-10A-L," manufactured by SEKONIC CORPORATION.

[Solid Content Concentrations of Dispersion of Toner Particles and Liquid Developer Solid Content Concentration of Which Is 25% by Mass]

Ten parts by mass of a sample is diluted with 90 parts by mass of hexane, and the dilution is spun with a centrifuge "H-201F," manufactured by KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and a lower layer is then dried with a vacuum dryer at 0.5 kPa and 40° C. for 8 hours. The solid content concentration is calculated according to the following formula:

$$\text{Solid Content Concentration, \% by Mass} = \frac{\text{Mass of Residues After Drying}}{\text{Mass of Sample, Corresponding to 10 Parts by Mass Portion}} \times 100$$

[Volume-Median Particle Size $D_{50}$ and CV Value of Toner Particles in Liquid Developer]

A volume-median particle size $D_{50}$ is determined with a laser diffraction/scattering particle size measurement instrument "Mastersizer 2000," manufactured by Malvern Instruments, Ltd., by charging a cell for measurement with Isopar L, manufactured by Exxon Mobile Corporation, isoparaffin, viscosity at 25° C.: 1 mPa·s, under conditions that a particle refractive index is 1.58, imaginary part being 0.1, and a dispersion medium refractive index is 1.42, at a concentration that gives a scattering intensity of from 5 to 15%.

In addition, a CV value (%) is calculated in accordance with the following formula:

$$CV\ \text{Value}\ (\%) = \frac{\text{Standard Deviation of Particle Size Distribution}}{\text{Volume-Median particle Size } D_{50}} \times 100$$

Production Example 1 of Resins [Resins A and B]

A 10-L four-neck flask equipped with a nitrogen inlet tube, a dehydration tube equipped with a fractional distillation tube through which hot water at 98° C. was allowed to flow, a stirrer, and a thermocouple was charged with raw material monomers and an esterification catalyst as listed in Table 1. The contents were heated to 180° C. and then heated to 210° C. over 5 hours, and the mixture was reacted until a reaction percentage reached 90%, the reaction mixture was further reacted at 8.3 kPa, and the reaction was terminated at a point where a softening point reached an intended value, to provide a polyester resin having the physical properties as listed in Table 1. Here, in Production Examples of Resins, the reaction percentage refers to a value calculated by: [amount of generated water in reaction (mol)/theoretical amount of generated water (mol)]×100.

Production Example 2 of Resins [Resins C and D]

A 10-L four-neck flask equipped with a nitrogen inlet tube, a dehydration tube, a stirrer, and a thermocouple was charged with raw material monomers, an esterification catalyst, and a polymerization inhibitor as listed in Table 1. The contents were reacted at 210° C., and the reaction mixture was reacted until a reaction percentage reached 90%. Further, the reaction mixture was reacted at 8.3 kPa, and a reaction was terminated at a point where a softening point reached an intended value, to provide a polyester resin having the physical properties as listed in Table 1.

Production Example 3 of Resin [Resin E]

A 10-L four-neck flask equipped with a nitrogen inlet tube, a dehydration tube, a stirrer, and a thermocouple was charged with raw material monomers and an esterification catalyst as listed in Table 1. The contents were reacted at 235° C., and the reaction mixture was reacted until a reaction percentage reached 90%. Further, the reaction mixture was reacted at 8.3 kPa, and a reaction was terminated at a point where a softening point reached an intended value, to provide a polyester resin having the physical properties as listed in Table 1.

Production Example 4 of Resin [Resin F]

A 10-L four-neck flask equipped with a nitrogen inlet tube, a dehydration tube, a stirrer, and a thermocouple was charged with raw material monomers for a polyester resin other than fumaric acid and trimellitic anhydride and an esterification catalyst as listed in Table 1. The contents were heated with a mantle heater to 230° C., and then reacted at 230° C. for 8 hours, and further reduced pressure to 8.3 kPa and reacted for one hour. The temperature of the reaction mixture was lowered to 170° C., and raw material monomers for a styrenic resin, a dually reactive monomer, and a polymerization initiator as listed in Table 1 were added dropwise from a dropping funnel over one hour. While holding the temperature at 170° C., the addition polymerization reaction was aged for one hour. Thereafter, the reaction mixture was heated to 210° C., and subjected to removal of the raw material monomers for the styrenic resin at 8.3 kPa for one hour, and a reaction of a dually reactive monomer and a polyester resin site were carried out. Further, trimellitic anhydride, fumaric acid, and a polymerization inhibitor were added thereto at 210° C., and a reaction was carried out until a softening point reached a value as listed in Table 1, to provide a composite resin having the physical properties as listed in Table 1.

Production Example 5 of Resin [Resin G]

A 10-L four-neck flask equipped with a nitrogen inlet tube, a dehydration tube, a stirrer, and a thermocouple was charged with raw material monomers for a polyester resin other than trimellitic anhydride and an esterification catalyst as listed in Table 1. The contents were heated with a mantle heater to 230° C., and then reacted at 230° C. for 8 hours, and further reduced pressure to 8.3 kPa and reacted thereat for one hour. The temperature of the reaction mixture was lowered to 170° C., and raw material monomers for a styrenic resin, a dually reactive monomer, and a polymerization initiator as listed in Table 1 were added dropwise from a dropping funnel over one hour. While holding the temperature at 170° C., the addition polymerization reaction was aged for one hour. Thereafter, the reaction mixture was heated to 210° C., and subjected to removal of the raw material monomers for the styrenic resin at 8.3 kPa for one hour, and a reaction of a dually reactive monomer and a polyester resin site were carried out. Further, trimellitic anhydride was added thereto at 210° C., and a reaction was carried out until a softening point reached a value as listed in Table 1, to provide a composite resin having the physical properties as listed in Table 1.

TABLE 1

| | | Resin A | Resin B | Resin C | Resin D | Resin E | Resin F | Resin G |
|---|---|---|---|---|---|---|---|---|
| Raw Material Monomers for Polyester Resin | 1,2-Propanediol | 3,640 g (100) | 3,083 g (100) | — | — | — | — | — |
| | BPA-PO[1)] | — | — | 7,702 g (100) | 7,437 g (100) | 4,313 g (60) | 3,357 g (50) | 4,046 g (70) |
| | BPA-EO[2)] | — | — | — | — | 2,670 g (40) | 3,117 g (50) | 1,610 g (30) |
| | Terephthalic acid | 6,360 g (80) | 5,387 g (80) | — | — | 2,898 g (85) | 2,101 g (66) | 1,288 g (47) |
| | Fumaric acid | — | — | 2,298 g (90) | 2,563 g (104) | — | 89 g (4) | — |
| | Dodecenylsuccinic anhydride | — | — | — | — | — | — | 791 g (18) |
| | Trimellitic anhydride | — | 530 g (7) | — | — | 118 g (3) | 295 g (8) | 729 g (23) |
| Dually Reactive Monomer | Acrylic acid | — | — | — | — | — | 41 g (3) | 36 g (3) |
| Esterification Catalyst | Tin(II) 2-ethylhexanoate | 50 g | 50 g | 50 g | 50 g | 50 g | 45 g | 45 g |
| Raw Material Monomers for Styrenic Resin | Styrene | — | — | — | — | — | 749 g (84) | 1,112 g (84) |
| | 2-Ethylhexyl acrylate | — | — | — | — | — | 143 g (16) | 212 g (16) |
| Polymerization Initiator | Dibutyl peroxide | — | — | — | — | — | 54 g | 79 g |
| Polymerization Inhibitor | 4-t-Butyl catechol | — | — | 5 g | 5 g | — | 5 g | — |
| Polyester Resin/Styrenic Resin (Mass Ratio) | | — | — | — | — | — | 90/10 | 85/15 |
| Physical Properties of Resin | Softening Point, ° C. | 87 | 95 | 84 | 101 | 101 | 90 | 113 |
| | Glass Transition Temp., ° C. | 47 | 55 | 46 | 57 | 61 | 50 | 58 |
| | Acid Value, mgKOH/g | 10 | 30 | 20 | 19 | 12 | 18 | 26 |

Note)

The numerical figures inside the parentheses in the raw material monomers for a polyester resin and the dually reactive monomer are expressed by a molar ratio when a total number of moles of the alcohol component is defined as 100. The numerical figures inside the parentheses in the raw material monomers for a styrenic resin are expressed by a mass ratio when a total mass of the raw material monomers for a styrenic resin is defined as 100.

[1)]Polyoxypropylene(2.2)-2,2-bis(4-hydroxyphenyl)propane

[2)]Polyoxyethylene(2.0)-2,2-bis(4-hydroxyphenyl)propane

Production Example 1 of Dispersants [Dispersants A to G]

A 2 L four-neck flask equipped with a reflux condenser, a nitrogen inlet tube, a stirrer, a dehydration tube, and a thermocouple was charged with raw materials for a basic nitrogen-containing group, raw materials for a dispersible group (maleic anhydride-modified polypropylene (PPSA)), and xylene manufactured by Wako Pure Chemical Industries, Ltd., and the internal of the reaction vessel was replaced with nitrogen gas. Thereafter, the internal of the reaction vessel was heated to 150° C., and the temperature was held thereat for one hour. Thereafter, the internal was heated to 160° C., and the temperature was held thereat for one hour. The pressure was reduced to 8.3 kPa at 160° C. to distill off the solvent. The time point at which a peak of acid anhydride ascribed to PPSA (1,780 $cm^{-1}$) disappears and a peak ascribed to imide bond (1,700 $cm^{-1}$) is generated according to the IR analysis is defined as a reaction end point, to provide each of dispersants having physical properties shown in Table 2.

Production Example 2 of [Dispersants H to K]

A 2 L four-neck flask equipped with a reflux condenser, a nitrogen inlet tube, a stirrer, a dehydration tube, and a thermocouple was charged with raw materials for a basic nitrogen-containing group, raw materials for a dispersible group (halogenated alkane), fine potassium carbonate powder manufactured by Wako Pure Chemical Industries, Ltd., and Acetonitrile, Super Dehydrated, manufactured by Wako Pure Chemical Industries, Ltd., and the internal of the reaction vessel was replaced with nitrogen gas. Thereafter, the internal of the reaction vessel was heated to 80° C., and the temperature was held thereat for 200 hour. Thereafter, the pressure was reduced to distill off the solvent. According to the residual proportion of the proton peaks of the primary and secondary amines of the polyethyleneimine according to NMR analysis, the reaction percentage was confirmed to be 95% or more, to provide each of dispersants having physical properties shown in Table 2.

Production Example 3 of Dispersant [Dispersant L]

A 1 L four-neck flask equipped with a reflux condenser, a nitrogen inlet tube, a stirrer, and a thermocouple was charged with 50 g of a reaction solvent xylene, and the internal of the reaction vessel was replaced with nitrogen gas. Thereafter, the internal of the reaction vessel was heated to 110° C., and a mixture of raw material monomers, a polymerization initiator, and 50 g of xylene as listed in Table 3 was added dropwise over 2 hours to carry out a polymerization reaction. After the termination of the dropwise addition, the reaction mixture was reacted at 110° C. for additional 3 hours. The solvent was distilled off at 110° C., to provide a dispersant composed of a copolymer having physical properties shown in Table 3.

TABLE 2

| | | Dispersant A | Dispersant B | Dispersant C | Dispersant D | Dispersant E | Dispersant F | Dispersant G | Dispersant H | Dispersant I | Dispersant J | Dispersant K |
|---|---|---|---|---|---|---|---|---|---|---|---|---|
| Raw Materials for Basic Nitrogen-Containing Group[1)] | Polyethyleneimine (PEI)300 | 7 | — | — | — | — | — | — | — | — | — | — |
| | Polyethyleneimine (PEI)600 | — | 9 | — | — | — | — | — | — | — | — | — |
| | Polyethyleneimine (PEI)1200 | — | — | 9 | — | 4 | 1.3 | — | 20 | 20 | 20 | 20 |
| | Polyethyleneimine (PEI)10000 | — | — | — | 1.3 | — | — | — | — | — | — | — |
| | TEP | — | — | — | — | — | — | 0.8 | — | — | — | — |
| | Number-Average Molecular Weight Mn | 1,500 | 2,500 | 3,400 | 12,000 | 3,400 | 3,400 | 189 | 3,400 | 3,400 | 3,400 | 3,400 |
| Raw Materials for Dispersible Group [2)] | PPSA1000 | 66.2 | 63 | 59.9 | 65.5 | — | — | 67.7 | — | — | — | — |
| | PPSA2500 | — | — | — | — | 66.5 | — | — | — | — | — | — |
| | PPSA8000 | — | — | — | — | — | 69.2 | — | — | — | — | — |
| | C12-Cl | — | — | — | — | — | — | — | 71 | — | — | — |
| | C16-Cl | — | — | — | — | — | — | — | — | 104 | — | — |
| | C18-Cl | — | — | — | — | — | — | — | — | — | 115 | — |
| | C22-Cl | — | — | — | — | — | — | — | — | — | — | 138 |
| | Number-Average Molecular Weight Mn | 1,000 | 1,000 | 1,000 | 1,000 | 2,500 | 8,000 | 1,000 | — | — | — | — |
| Solvent | Xylene | 73.2 | 72 | 68.9 | 66.8 | 70.5 | 70.5 | 68.5 | — | — | — | — |
| | Ultradehydrated Acetonitrile | — | — | — | — | — | — | — | 145 | 179 | 190 | 212 |
| Neutralizing Agent | Potassium Carbonate | — | — | — | — | — | — | — | 55 | 55 | 55 | 55 |
| Physical Properties | Melting Point, ° C. | 90 | 92 | 97 | 103 | 117 | 142 | 92 | −8 | 34 | 50 | 66 |

Note)
The amount used is in mass ratio.
[1)]Polyethyleneimine 300, 600, 1200, and 10000: all are manufactured by JUNSEI CHEMICAL CO., LTD., TEP: tetraethylenepentamine: manufactured by KANTO CHEMICAL CO., INC.
[2)] PPSA1000: X-10065 manufactured by Baker Hughes, mp: 108° C.
PPSA2500: X-10088 manufactured by Baker Hughes, mp: 132° C.
PPSA8000: X-10082 manufactured by Baker Hughes, mp: 155° C.
C12-Cl: 1-chlorodecane, manufactured by TCI
C16-Cl: 1-chlorohexadecane, manufactured by TCI
C18-Cl: 1-chlorooctadecane, manufactured by TCI
C22-Cl: 1-chlorodocosadecane, manufactured by TCI

TABLE 3

| | | Dispersant L |
|---|---|---|
| Raw Material Monomers | 2-(Dimethylamino)ethyl methacrylate (DMAEMA) | 20 g |
| | Octadecyl methacrylate (SMA) | 80 g |
| Polymerization Initiator | V-65 | 10 g |
| Solvent | Xylene | 50 g + 50 g |
| Physical Properties | Weight-Average Molecular Weight | 7,800 |
| | Melting Point, ° C. | 29 |

2-(Dimethylamino)ethyl methacrylate: manufactured by Wako Pure Chemical Industries, Ltd.
Octadecyl methacrylate: manufactured by Wako Pure Chemical Industries, Ltd.
V-65: 2,2'-azobis(2,4-dimethylvaloronitrile), manufactured by Wako Pure Chemical Industries, Ltd.

EXAMPLES 1 TO 11 AND COMPARATIVE EXAMPLES 1 TO 4

[Preparation of Dispersion of Resin Particles (Emulsion-Phase Inversion Step)]

A 2 L vessel equipped with a stirrer, a reflux condenser, and a thermometer was charged with 300 g of a resin D and 300 g of methyl ethyl ketone. The contents were heated to 60° C. while stirring, and the temperature was held at 60° C. over 30 minutes to dissolve the resin. The solution obtained was cooled to 30° C., 5.1 g of a 25% by mass aqueous ammonia solution was added thereto, and the temperature was held at 30° C. for 30 minutes.

Next, with holding the temperature at 30° C., 712 g of deionized water was added over 60 minutes while stirring at 200 r/min (peripheral speed: 63 m/min) to allow emulsion phase-inversion. The emulsified mixture was heated to 60° C., and methyl ethyl ketone was distilled off under a reduced pressure, to provide an aqueous dispersion. Thereafter, the aqueous dispersion was cooled to 30° C., while stirring at 200 r/min (peripheral speed: 63 m/min), and deionized water was then added so as to have a solid content concentration of 20% by mass, to thereby provide a dispersion of resin particles of a resin D having physical properties shown in Table 4.

[Preparation of Dispersion of Colorant Particles]

In a 1-L beaker were mixed 150 g of a colorant "ECB-301" manufactured by DAINICHISEIKA COLOR & CHEMICALS MFG. CO., LTD., Phthalocyanine Blue 15:3, 200 g of an anionic surfactant "NEOPELEX(registered trademark) G-15," manufactured by KAO Corporation (15% by mass aqueous sodium dodecylbenzenesulfonate), and 257 g of deionized water, and the mixture was dispersed at room temperature (25° C.) for 3 hours with a ultrasonic homogenizer "US-600T" manufactured by NIHONSEIKI KAISHA, LTD. Thereafter, deionized water was added to the dispersion so as to have a solid content concentration of 24% by mass, to thereby provide a colorant dispersion. The volume-median particle size $D_{50}$ of the colorant particles in the dispersion was 0.10 μm.

[Preparation of Toner Particles]

In a 3-L four-neck flask equipped with a dehydration tube, a stirring device, and a thermocouple were mixed 300 g of a dispersion of resin particles, 45 g of a dispersion of colorant particles, and 9 g of a 10% by mass aqueous solution of a nonionic surfactant "EMULGEN(registered trademark) 150" manufactured by KAO Corporation (polyoxyethylene(average number of moles added: 50) lauryl ether) at 25° C. Next, while stirring the mixture, a solution adjusted to a pH of 8.5 by adding 10 g of a 4.8% by mass aqueous potassium hydroxide solution to an aqueous solution of 8 g of ammonium sulfate dissolved in 180 g of deionized water was added dropwise to the mixture at 25° C. over 5 minutes. Thereafter, the contents were heated to 65° C. over 3 hours, and the temperature was held at 65° C. until a volume-median particle size $D_{50}$ of the aggregated particles became 2.5 μm, to provide a dispersion of aggregated particles.

To the dispersion of aggregated particles was added an aqueous solution prepared by mixing 10 g of an anionic surfactant "EMAL(registered trademark) E-27C" manufactured by KAO Corporation, sodium polyoxyethylene lauryl ether sulfate, effective concentration: 27% by mass, 900 g of deionized water, and 30 g of 0.1 mol/L sulfuric acid. Thereafter, contents were heated to 85° C. over 1 hour, and the temperature was held at 85° C. until a circularity reached a value of 0.985, to thereby provide a dispersion of unified particles in which the aggregated particles were fused.

The dispersion of unified particles obtained was cooled to 30° C., the dispersion was subjected to suction filtration to separate a solid content, and the residues were washed with deionized water at 25° C., and then subjected to suction filtration at 25° C. for 2 hours. Thereafter, the solids were vacuum-dried at 40° C. for 48 hours with a vacuum oven dryer DRV622DA, manufactured by ADVANTEC, to provide toner particles having physical properties shown in Table 4.

[Preparation of Liquid Developer]

Fifty parts by mass of toner particles and 5 parts by mass of a dispersant as listed in Table 5 were added to 102 parts by mass of an insulating liquid as listed in Table 5, and the mixture was stirred with a homogenizing mixer T18 digital ULTRA-TURRAX manufactured by IKA at 25° C. for 10 minutes at 10,000 r/min. The solid content concentration was diluted to 25% by mass, to provide a liquid developer having physical properties shown in Table 5.

EXAMPLES 12 TO 14

The same procedures as in Example 3 were carried out except that the resin A or the resin C was urethane-modified according to the following method, to prepare a dispersion of resin particles, and used, to provide each of the liquid developers having physical properties shown in Tables 5 and 6.

[Preparation of Dispersion of Resin Particles]

<Urethane Stretching Step>

A 2 L vessel equipped with a stirrer, a reflux condenser, a thermometer, and a nitrogen inlet tube was charged with 200 g of a resin as listed in Table 4, and methyl ethyl ketone, dimethylolbutanoic acid, and tin(II) 2-ethylhexanoate each as listed in Table 4, which were previously subjected to a dehydration treatment with molecular sieves, under a nitrogen atmosphere. The contents were heated to 80° C. while stirring, and the temperature was held at 80° C. over 30 minutes to dissolve the resin. Hexamethylene diisocyanate as listed in Table 4 was added to the solution obtained, and the temperature was held at 80° C. for 5 hours, to provide a methyl ethyl ketone solution of a urethane-modified polyester resin.

<Emulsion Phase-Inversion Step>

Next, the solution obtained was cooled to 30° C., methyl ethyl ketone and a 25% by mass aqueous ammonia solution as listed in Table 4 were added thereto, and the temperature was held for 30 minutes while stirring. Next, with holding the temperature at 30° C., deionized water as listed in Table 4 was added thereto over 60 minutes while stirring at 200 r/min (peripheral speed: 63 m/min) to cause emulsion phase-inversion. The internal was heated to 60° C., and methyl ethyl ketone was distilled off under a reduced pressure, to provide an aqueous dispersion. Thereafter, the aqueous dispersion was cooled to 30° C., while stirring at 200 r/min (peripheral speed: 63 m/min), and deionized water was then added thereto so as to have a solid content concentration of 20% by mass, to thereby provide a dispersion of resin particles having physical properties shown in Table 4.

TABLE 4

| | | Exs. 1 to 11 Comp. Exs. 1 to 4 | Exs. 12 and 13 | Ex. 14 |
|---|---|---|---|---|
| | Resin | Resin D 300 g | Resin A 200 g | Resin C 200 g |
| Urethane stretching step | Dimethylolbutanoic acid | — | 11.3 g | 4.6 g |
| | Methyl ethyl ketone | — | 186 g | 171 g |
| | Tin(II) 2-ethylhexanoate | — | 1 g | 1 g |
| | Hexamethylene diisocyanate | — | 36.3 g | 22.8 g |
| Emulsion phase-inversion step | 25% by Mass aqueous ammonia | 5.1 g | 4.5 g | 5.9 g |
| | Methyl ethyl ketone | 300 g | 195 g | 198 g |
| | Deionized water | 712 g | 578 g | 531 g |
| Dispersion of resin particles | PH | 6.8 | 6.9 | 6.7 |
| Physical properties of resin particles | Volume-median particle size, nm | 100 | 160 | 90 |
| | CV value, % | 20 | 26 | 18 |
| | Glass transition temperature, ° C. | 57 | 70 | 62 |
| | Softening point, ° C. | 100 | 126 | 118 |
| Physical properties of toner particles | Volume-median particle size, nm | 2.5 | 2.5 | 2.4 |
| | CV value, % | 19 | 20 | 21 |
| | Glass transition temperature, ° C. | 46 | 59 | 52 |
| | Softening point, ° C. | 95 | 107 | 101 |

EXAMPLES 15 TO 20

[Preparation of Toner Particles]

Eighty-five parts by mass of a resin binder as listed in Table 6 and 15 parts by mass of a colorant "ECB-301" manufactured by DAINICHISEIKA COLOR & CHEMICALS MEG. CO., LTD., Phthalocyanine Blue 15:3, were previously stirred with a 20-L Henschel mixer for 3 minutes at a rotational speed of 1,500 r/min (peripheral speed 21.6 m/sec), and the mixture was melt-kneaded under the conditions given below.

[Melt-Kneading Conditions]

A continuous twin open-roller type kneader "Kneadex," manufactured by NIPPON COKE & ENGINEERING CO., LTD. having an outer diameter of roller of 14 cm and an effective length of roller of 55 cm was used. The operating conditions of the continuous twin open-roller type kneader were a peripheral speed of a high-rotation roller (front roller) of 75 r/min (32.4 m/min), a peripheral speed of a low-rotation roller (back roller) of 35 r/min (15.0 m/min), and a gap between the rollers at an end of the kneaded product supplying side of 0.1 mm. The temperatures of the heating medium and the cooling medium inside the rollers were as follows.

The high-rotation roller had a temperature at the raw material supplying side of 90° C., and a temperature at the kneaded product-discharging side of 85° C., and the low-rotation roller had a temperature at the raw material supplying side of 35° C., and a temperature at the kneaded product-discharging side of 35° C. In addition, the feeding rate of the raw material mixture to the kneader was 10 kg/h, and the average residence time in the kneader was about 3 minutes.

The kneaded product obtained above was roll-cooled with a cooling roller, and the cooled product was roughly pulverized with a hammer-mill to a size of 1 mm or so, and then finely pulverized and classified with an air jet type jet mill "IDS," manufactured by Nippon Pneumatic Mfg. Co., Ltd., to provide toner particles having a volume-median particle size $D_{50}$ of 10 μm.

[Preparation of Liquid Developer]

A 2-L polyethylene vessel was charged with 100 g of toner particles, 204 g of an insulating liquid as listed in Table 6, and 10 g of a dispersant C, and the contents were stirred with "T.K. ROBOMIX," manufactured by PRIMIX Corporation, under ice-cooling at a rotational speed of 7,000 r/min for 30 minutes, to provide a dispersion of toner particles, a solid content concentration of which was 35% by mass.

Next, the dispersion of toner particles obtained was subjected to wet-milling for 4 hours with 6 vessels-type sand grinder "TSG-6," manufactured by AIMEX CO., LTD., at a rotational speed of 1,300 r/min (peripheral speed 4.8 msec) using zirconia beads having a diameter of 0.8 mm at a volume filling ratio of 60% by volume. The beads were removed by filtration, and the filtrate was diluted with the insulating liquid, to provide a liquid developer, a solid content concentration of which was 25% by mass, the liquid developer having physical properties as shown in Table 6.

EXAMPLE 21

[Preparation of Toner Particles]

Eighty-five parts by mass of a resin D, 15 parts by mass of a colorant "ECB-301" manufactured by DAINICHISEIKA COLOR & CHEMICALS MFG. CO., LTD., Phthalocyanine Blue 15:3, and 10 parts by mass of a dispersant C were previously mixed with a 20-L Henschel mixer while stirring for 3 minutes at a rotational speed of 1,500 r/min (peripheral speed 21.6 m/sec). Thereafter, the melt-kneading, the pulverization, and the classification were carried out in the same manner as in Example 13, to provide toner particles.

[Preparation of Liquid Developer]

A 2-L polyethylene vessel was charged with 100 g of the toner particles obtained and 186 g of an insulating liquid as listed in Table 6, and the contents were stirred with "T.K. ROBOMIX," manufactured by PRIMIX Corporation, under ice-cooling at a rotational speed of 7,000 r/min for 30 minutes, to provide a dispersion of toner particles, a solid content concentration of which was 35% by mass.

Next, the dispersion of toner particles obtained was subjected to wet-milling for 4 hours with 6 vessels-type sand grinder "TSG-6," manufactured by AIMEX CO., LTD., at a rotational speed of 1,300 r/min (peripheral speed 4.8 m/sec) using zirconia beads having a diameter of 0.8 mm at a volume filling ratio of 60% by volume. The beads were removed by filtration, and the filtrate was diluted with the insulating liquid, to provide a liquid developer, a solid content concentration of which was 25% by mass, the liquid developer having physical properties as shown in Table 6.

Test Example (Fusing Ability to Resin Film)

A liquid developer was added dropwise to an untreated surface of each of the resin films given hereinbelow, and a thin film was produced with a wire bar so that the mass on dry basis would be 1.2 g/m$^2$. Thereafter, the produced thin film was held in a thermostat at 80° C. for 3 minutes to fuse.

[Resin Film]

PET: "LUMIRROR T60 #75" manufactured by TORAY INDUSTRIES, LTD.

PP: "FOR25" manufactured by FUTAMURA CHEMICAL CO., LTD.

Nylon: "EMBLEM ON-25" manufactured by UNITICA LTD.

The fused images obtained were adhered to a mending tape "Scotch Mending Tape 810," manufactured by 3M, width of 18 mm, the tape was pressed with a roller so as to apply a load of 500 g thereto, and the tape was then removed. The optical densities before and after tape removal were measured with a colorimeter "GretagMacbeth Spectroeye," manufactured by Gretag. The fused image-printed portions were measured at 3 points each, and an average thereof was calculated as an optical density. A fusing ratio (%) was calculated from a value of: [optical density after removal]/[optical density before removal]×100. The results are shown in Tables 5 and 6. The larger the numerical value of the fusing ratio, the more excellent the fusing ability.

TABLE 5

| | | Ex. 1 | Ex. 2 | Ex. 3 | Ex. 4 | Ex. 5 | Ex. 6 | Ex. 7 |
|---|---|---|---|---|---|---|---|---|
| Toner | Resin Binder | Resin D | Resin D | Resin D | Resin D | Resin D | Resin D | Resin D |
| Insulating Liquid | Insulating Liquid | Isopar L | Isopar L | Isopar L | Isopar L | Isopar L | Isopar L | Isopar L |
| | Viscosity, mPa · s | 1.0 | 1.0 | 1.0 | 1.0 | 1.0 | 1.0 | 1.0 |
| Dispersant | Dispersant | Dispersant A | Dispersant B | Dispersant C | Dispersant D | Dispersant E | Dispersant F | Dispersant G |

TABLE 5-continued

| | | | | | | | | |
|---|---|---|---|---|---|---|---|---|
| | Raw Materials for Basic Nitrogen-Containing Group | PEI 300 | PEI 600 | PEI 1200 | PEI 10000 | PEI 1200 | PEI 1200 | TEP |
| | Mn of Raw Materials for Basic Nitrogen-Containing Group | 1,500 | 2,500 | 3,400 | 12,000 | 3,400 | 3,400 | 189 |
| | Raw Materials for Dispersible Group | PPSA 1000 | PPSA 1000 | PPSA 1000 | PPSA 1000 | PPSA 2500 | PPSA 8000 | PPSA 1000 |
| | Mn of Raw Materials for Dispersible Group | 1,000 | 1,000 | 1,000 | 1,000 | 2,500 | 8,000 | 1,000 |
| | Melting Point, ° C. | 90 | 92 | 97 | 103 | 117 | 142 | 92 |
| Physical Properties of Liquid Developer | $D_{50}$, μm | 2.2 | 2.2 | 2.4 | 2.5 | 2.5 | 2.5 | 2.1 |
| | Viscosity, mPa · s | 2 | 2 | 2 | 3 | 3 | 5 | 5 |
| Evaluations for Fusing | PET Fusing Ratio, % | 100 | 100 | 100 | 100 | 100 | 100 | 100 |
| | PP Fusing Ratio, % | 91 | 95 | 100 | 100 | 97 | 93 | 90 |
| | Nylon Fusing Ratio, % | 35 | 24 | 15 | 9 | 10 | 11 | 25 |

| | | | Ex. 8 | Ex. 9 | Ex. 10 | Ex. 11 | Ex. 12 | Ex. 13 |
|---|---|---|---|---|---|---|---|---|
| Toner | Resin Binder | | Resin D | Resin D | Resin D | Resin D | Urethane-Modified Resin A | Urethane-Modified Resin A |
| Insulating Liquid | Insulating Liquid | | Isopar L | Isopar L | Isopar L | NAS-3 | Isopar L | NAS-3 |
| | Viscosity, mPa · s | | 1.0 | 1.0 | 1.0 | 1.0 | 1.0 | 1.0 |
| Dispersant | Dispersant | | Dispersant I | Dispersant J | Dispersant K | Dispersant C | Dispersant C | Dispersant C |
| | Raw Materials for Basic Nitrogen-Containing Group | | PEI 1200 | PEI 1200 | PEI 1200 | PEI 1200 | PEI 1200 | PEI 1200 |
| | Mn of Raw Materials for Basic Nitrogen-Containing Group | | 3,400 | 3,400 | 3,400 | 3,400 | 3,400 | 3,400 |
| | Raw Materials for Dispersible Group | | C16-Cl | C18-Cl | C22-Cl | PPSA 1000 | PPSA 1000 | PPSA 1000 |
| | Mn of Raw Materials for Dispersible Group | | — | — | — | 1,000 | 1,000 | 1,000 |
| | Melting Point, ° C. | | 34 | 50 | 66 | 97 | 97 | 97 |
| Physical Properties of Liquid Developer | $D_{50}$, μm | | 2.2 | 2.5 | 3.0 | 2.4 | 2.5 | 2.4 |
| | Viscosity, mPa · s | | 2 | 2 | 10 | 2 | 3 | 2 |
| Evaluations for Fusing | PET Fusing Ratio, % | | 92 | 95 | 98 | 100 | 100 | 100 |
| | PP Fusing Ratio, % | | 5 | 10 | 15 | 100 | 100 | 100 |
| | Nylon Fusing Ratio, % | | 21 | 16 | 9 | 45 | 98 | 100 |

Note)

Isopar L: manufactured by Exxon Mobile Corporation, isoparaffin, conductivity: $6.2 \times 10^{-13}$ S/m, viscosity at 25° C.: 1 mPa · s, boiling point: 203° C.

NAS-3: manufactured by NOF, polyisobutene, conductivity: $1.68 \times 10^{-12}$ S/m, viscosity at 25° C.: 1 mPa · s, boiling point: 168° C.

TABLE 6

| | | Ex. 14 | Ex. 15 | Ex. 16 | Ex. 17 | Ex. 18 | Ex. 19 | Ex. 20 |
|---|---|---|---|---|---|---|---|---|
| Toner | Resin Binder | Urethane-Modified Resin C | Resin D | Resin B | Resin B | Resin F/Resin G = 50/50, Mass Ratio | Resin E | Resin E |
| Insulating Liquid[1)] | Insulating Liquid | Isopar L | Isopar L | Isopar L | NAS-3 | Isopar L | Isopar L | NAS-3 |
| | Viscosity, mPa · s | 1.0 | 1.0 | 1.0 | 1.0 | 1.0 | 1.0 | 1.0 |
| Dispersant[2)] | Dispersant | Dispersant C | Dispersant C | Dispersant C | Dispersant C | Dispersant C | Dispersant C | Dispersant C |
| | Raw Materials for Basic Nitrogen-Containing Group | PEI 1200 | PEI 1200 | PEI 1200 | PEI 1200 | PEI 1200 | PEI 1200 | PEI 1200 |
| | Mn of Raw Materials for Basic Nitrogen-Containing Group | 3,400 | 3,400 | 3,400 | 3,400 | 3,400 | 3,400 | 3,400 |
| | Raw Materials for Dispersible Group | PPSA 1000 | PPSA 1000 | PPSA 1000 | PPSA 1000 | PPSA 1000 | PPSA 1000 | PPSA 1000 |
| | Mn of Raw Materials for Dispersible Group | 1,000 | 1,000 | 1,000 | 1,000 | 1,000 | 1,000 | 1,000 |
| | Melting Point, ° C. | 97 | 97 | 97 | 97 | 97 | 97 | 97 |

TABLE 6-continued

| | | | | | | | | |
|---|---|---|---|---|---|---|---|---|
| Physical Properties of Liquid Developer | $D_{50}$, μm | 2.4 | 2.5 | 2.2 | 1.8 | 2.0 | 2.6 | 1.5 |
| | Viscosity, mPa · s | 3 | 3 | 3 | 2 | 3 | 5 | 3 |
| Evaluations for Fusing | PET Fusing Ratio, % | 100 | 100 | 100 | 100 | 100 | 100 | 100 |
| | PP Fusing Ratio, % | 100 | 100 | 100 | 100 | 100 | 100 | 100 |
| | Nylon Fusing Ratio, % | 92 | 78 | 85 | 90 | 9 | 68 | 73 |

| | | | Ex. 21 | Comp. Ex. 1 | Comp. Ex. 2 | Comp. Ex. 3 | Comp. Ex. 4 |
|---|---|---|---|---|---|---|---|
| | Toner | Resin Binder | Resin D | Resin D | Resin D | Resin D | Resin D |
| | Insulating Liquid[1)] | Insulating Liquid | Isopar L | Isopar L | Isopar L | Isopar L | Isopar L |
| | | Viscosity, mPa · s | 1.0 | 1.0 | 1.0 | 1.0 | 1.0 |
| | Dispersant[2)] | Dispersant | Disper-sant C | Disper-sant H | S11200 | Disper-sant L | V-220 |
| | | Raw Materials for Basic Nitrogen-Containing Group | PEI 1200 | PEI 1200 | PEI | DMAEMA (tertiary amine) | Vinyl pyrrolidone (amide) |
| | | Mn of Raw Materials for Basic Nitrogen-Containing Group | 3,400 | 3,400 | — | — | — |
| | | Raw Materials for Dispersible Group | PPSA 1000 | C12-Cl | p-HSA | SMA (C18) | Eicosene (C20) |
| | | Mn of Raw Materials for Dispersible Group | 1,000 | — | — | — | — |
| | | Melting Point, ° C. | 97 | −8 | −17 | 29 | 49 |
| | Physical Properties of Liquid Developer | $D_{50}$, μm | 1.8 | 5.2 | 2.5 | 2.1 | 4.5 |
| | | Viscosity, mPa · s | 2 | 3 | 3 | 3 | 25 |
| | Evaluations for Fusing | PET Fusing Ratio, % | 100 | 74 | 23 | 85 | 82 |
| | | PP Fusing Ratio, % | 100 | 4 | 3 | 12 | 15 |
| | | Nylon Fusing Ratio, % | 85 | 25 | 4 | 6 | 6 |

[1)]Isopar L: manufactured by Exxon Mobile Corporation, isoparaffin, conductivity: $6.2 \times 10^{-13}$ S/m, viscosity at 25° C.: 1 mPa · s, boiling point: 203° C.
NAS-3: manufactured by NOF, polyisobutene, conductivity: $1.68 \times 10^{-12}$ S/m, viscosity at 25° C.: 1 mPa · s, boiling point: 168° C.
[2)]S11200 (SOLSPARSE 11200): manufactured by Lubrizol Corporation, a condensate of a polyimine (polyethyleneimine) and a carboxylic acid (12-hydroxystearic acid (p-HSA), average degree of polymerization: 7.0, effective content: 50% by mass, weight-average molecular weight: 10,400, polyimine/carboxylic acid (mass ratio) = 7/93, melting point: −17° C.
V-220 (Antaron V-220): (eicosene/vinyl pyrrolidone) copolymer, melting point: 49° C.

It can be seen from the above results that the liquid developers of Examples 1 to 21 are excellent in fusing even on an untreated resin film.

On the other hand, the liquid developers of Comparative Examples 1 to 3 where the melting points of the dispersants are low and the liquid developer of Comparative Example 4 where the dispersant has an amide group are deficient in fusing ability to a resin film.

The liquid developer of the present invention is suitably used in development or the like of latent images formed in, for example, electrophotography, electrostatic recording method, electrostatic printing method or the like.

The invention claimed is:

1. A liquid developer comprising a resin binder, a colorant, a dispersant, and an insulating liquid, wherein the resin binder comprises a resin having an acidic group, wherein the dispersant comprises a dispersant X which is a reaction product of a polyalkyleneimine and a polypropylene having a carboxy group, wherein a melting point of the dispersant X is 80° C. or higher and 150° C. or lower.

2. The liquid developer according to claim 1, wherein the resin having an acidic group is a polyester-based resin.

3. The liquid developer according to claim 2, wherein the polyester-based resin is a polyester resin or a composite resin comprising a polyester resin and a styrenic resin.

4. The liquid developer according to claim 1, wherein the polyalkyleneimine has a number-average molecular weight of 100 or more and 15,000 or less.

5. The liquid developer according to claim 1, wherein the boiling point of the insulating liquid is 120° C. or higher and 300° C. or lower.

6. The liquid developer according to claim 1, wherein the viscosity of the insulating liquid at 25° C. is 1 mPa·s or more and 100 mPa·s or less.

7. The liquid developer according to claim 1, wherein the insulating liquid comprises a polyisobutene.

8. The liquid developer according to claim 1, wherein the resin having an acidic group is a modified polyester resin having a urethane bond.

9. A method for printing a fused image on a resin film using a liquid developer according to claim 1, wherein the resin film is a polypropylene film.

10. A method for printing a fused image on a resin film using a liquid developer according to claim 8, wherein the resin film is a nylon film.

11. A method for printing a fused image on a resin film using a liquid developer according to claim 1.

12. The method for printing a fused image according to claim 11, wherein the resin film is a polyethylene terephthalate film.

13. The method for printing a fused image according to claim 11, wherein the resin film is a resin film without a pretreatment with a surface modifying agent.

14. The liquid developer according to claim 7, wherein the degree of polymerization of the polyisobutene is 2 or more and 8 or less.

15. The liquid developer according to claim 7, wherein the boiling point of the polyisobutene is 120° C. or higher and 300° C. or lower.

16. A method for producing a liquid developer according to claim 1, comprising:

(a) melt-kneading a resin binder comprising a polyester-based resin and a colorant, and pulverizing a kneaded product obtained, to obtain toner particles;

(b) adding a dispersant to the toner particles obtained in (a), and dispersing the toner particles in an insulating liquid to obtain a dispersion of toner particles; and (c) subjecting the dispersion of toner particles obtained in (b) to wet-milling, to obtain a liquid developer.

17. The liquid developer according to claim 1, wherein the polypropylene having a carboxy group comprises a maleic anhydride-modified polypropylene.

* * * * *